US011719084B2

(12) United States Patent
Wensrich et al.

(10) Patent No.: US 11,719,084 B2
(45) **Date of Patent: *Aug. 8, 2023**

(54) BOTTOM HOLE ASSEMBLY INCLUDING A RESTTABLE PLUG AND ASSOCIATED METHODS OF USE

(71) Applicants: Jeffrey Bruce Wensrich, Houston, TX (US); Sam Noam Schroit, Houston, TX (US)

(72) Inventors: Jeffrey Bruce Wensrich, Houston, TX (US); Sam Noam Schroit, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/467,232

(22) Filed: Sep. 5, 2021

(65) Prior Publication Data

US 2022/0025751 A1 Jan. 27, 2022

Related U.S. Application Data

(63) Continuation-in-part of application No. 15/869,889, filed on Jan. 12, 2018, now Pat. No. 11,156,057.

(60) Provisional application No. 62/577,176, filed on Oct. 26, 2017, provisional application No. 62/557,362, filed on Sep. 12, 2017, provisional application No. 62/534,200, filed on Jul. 19, 2017, provisional application No. 62/479,654, filed on Mar. 31, 2017, provisional application No. 62/450,558, filed on Jan. 25, 2017, provisional application No. 62/449,996, filed on Jan. 24, 2017, provisional application No. 62/449,033, filed on Jan. 22, 2017, provisional application No. 62/447,801, filed on Jan. 18, 2017, provisional application No. 62/446,512, filed on Jan. 15, 2017.

(51) Int. Cl.

| | |
|---|---|
| ***E21B 43/26*** | (2006.01) |
| ***E21B 33/12*** | (2006.01) |
| ***E21B 23/01*** | (2006.01) |
| ***E21B 23/06*** | (2006.01) |
| ***E21B 34/10*** | (2006.01) |

(52) U.S. Cl.

CPC ..... *E21B 43/26* (2013.01); *E21B 23/01* (2013.01); *E21B 23/06* (2013.01); *E21B 33/12* (2013.01); *E21B 34/10* (2013.01)

(58) Field of Classification Search

CPC ..... E21B 23/01; E21B 23/06; E21B 33/12; E21B 34/10; E21B 43/26

See application file for complete search history.

(56) References Cited

U.S. PATENT DOCUMENTS 6,394,184 B2 * 5/2002 Tolman ..... E21B 43/26 166/308.1
2001/0050172 A1 * 12/2001 Tolman ..... E21B 33/12 166/305.1

(Continued)

*Primary Examiner* — Blake Michener

(57) ABSTRACT

Systems and methods are disclosed that enable efficient well completion operations and provide the ability of flushing the wellbore before, during and after a fracturing or treatment operation, such that a resettable plug and associated bottom hole assembly is not trapped or buried by fluids and particulates in the hole and the sealing element of the resettable plug is not damaged. Systems and methods which mitigate and prevent accumulation of fluids and particulates above a resettable plug are also provided. Systems and methods for delivering pressurized fluid to a subterranean formation are also disclosed.

21 Claims, 20 Drawing Sheets

(56) References Cited

U.S. PATENT DOCUMENTS

| | | | | |
|---|---|---|---|---|
| 2002/0020535 | A1* | 2/2002 | Johnson | E21B 37/08 166/278 |
| 2012/0175108 | A1* | 7/2012 | Foubister | E21B 47/117 166/126 |
| 2015/0075783 | A1* | 3/2015 | Angman | E21B 47/26 166/308.1 |
| 2016/0024902 | A1* | 1/2016 | Richter | E21B 43/267 166/250.01 |
| 2017/0138150 | A1* | 5/2017 | Yencho | E21B 43/26 |
| 2017/0268320 | A1* | 9/2017 | Angman | E21B 23/10 |

* cited by examiner

BOTTOM HOLE ASSEMBLY INCLUDING A RESTTABLE PLUG AND ASSOCIATED METHODS OF USE

CROSS-REFERENCE TO RELATED APPLICATIONS

This Continuation-In-Part Application claims the benefit of priority of U.S. patent application Ser. No. 15/869,889 filed on Jan. 12, 2018, being incorporated by reference herein.

BACKGROUND

The present disclosure relates to a downhole tool including a resettable plug and a bottom hole assembly which facilitates treatment of a subterranean formation through a downhole tubular.

A bottom hole assembly is an apparatus that is adapted for use within a borehole that extends into the earth to reach a target subterranean formation that is expected to contain valuable hydrocarbons, such as oil, gas and combinations thereof. A bottom hole assembly may be run into an existing borehole on a wireline that may provide a physical tether as well as providing connections for electrical power delivery and data communication between the bottom hole assembly and a computer system at the surface near the borehole. Furthermore, a bottom hole assembly may include one or more downhole tools, components or subsystems that perform one or more functions of the bottom hole assembly.

Certain downhole tools may include a resettable plug. A resettable plug may be activated or set to seal off one portion of the borehole from another portion of the borehole. The resettable plug may later be deactivated to retract the seal, such that the fluid communication around the resettable plug is restored. Optionally, the resettable plug may be repositioned within the borehole and reactivated or set.

A bottom hole assembly (BHA), including a downhole tool that includes the resettable plug, may be deployed within the borehole, such that the resettable plug may be activated and deactivated at various locations within the borehole. In this manner, the resettable plug may be used in conjunction with a formation fracturing process, formation treatment process, other processes, or other downhole operations at multiple locations within the borehole without removal of the bottom hole assembly from the borehole.

BRIEF SUMMARY OF THE INVENTION

One embodiment provides a resettable plug downhole tool for use within a borehole that extends into a subterranean formation. The resettable plug downhole tool comprises a resettable plug, a valve, a pressure sensor, and a valve actuator. The resettable plug includes a central body, a selectively deployable sealing element about a periphery of the central body, and a fluid passageway that extends through the central body from a first opening in the central body on a first side of the deployable sealing element to a second opening in the central body on a second side of the deployable sealing element. The valve is disposed to control fluid flow through the fluid passageway, the pressure sensor is disposed to sense fluid pressure within the borehole on the first side of the deployable sealing element, and the valve actuator is coupled to the valve for controlling operation of the valve. Another embodiment provides a method of controlling fluid flow through a resettable plug. The method comprises monitoring a pressure of fluid within a borehole above the resettable plug, and controlling operation of a valve to prevent the monitored fluid pressure from exceeding a setpoint pressure, wherein the valve controls fluid flow through a passageway in the resettable plug, and wherein the passageway extends from a first opening above the resettable plug to a second opening below the resettable plug.

In another embodiment, a bottom hole assembly (BHA) comprises the resettable plug downhole tool, an actuator tool, a gripping tool and a locating tool.

In a further embodiment, there is provided a method of delivering a treatment fluid into a formation intersected by a borehole, the method comprising the steps of: deploying the BHA on wireline; utilizing the locating tool to locate a ported tubular segment within the borehole; positioning the BHA near the ported tubular segment such that the resettable plug downhole tool is below and near the ported tubular segment; activating the resettable plug downhole tool to engage the borehole; extending the actuator tool inside the ported tubular segment; gripping a closure cover over the ported tubular segment with the gripping tool secured at the end of the actuator tool; retracting the actuator tool to open the closure cover over the openings of the ported tubular segment; and delivering a treatment fluid through the ported tubular segment to the formation.

DETAILED DESCRIPTION OF THE INVENTION

Figures 1A, 1B, 1C:
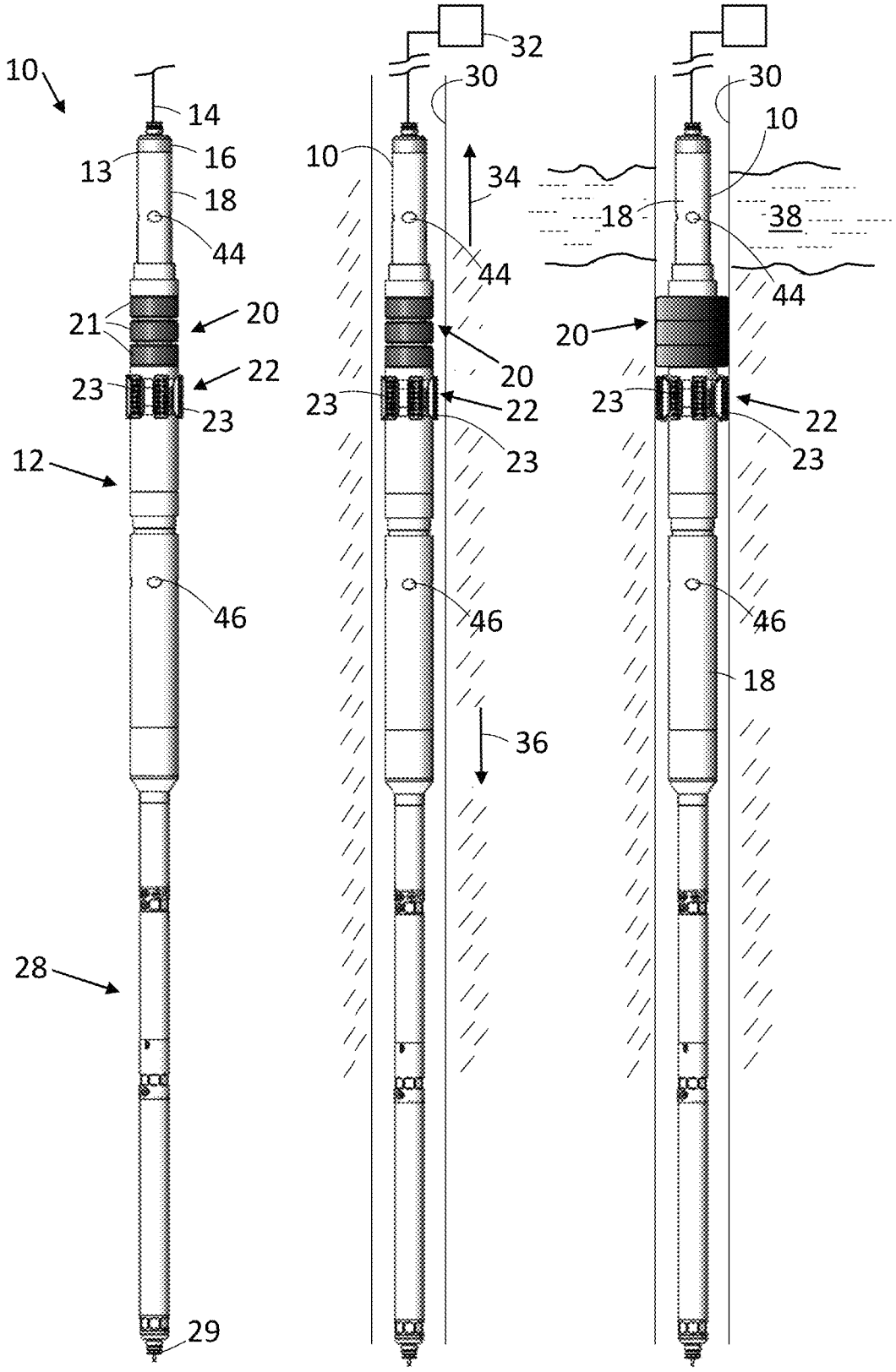
FIGS. 1A-C are diagrams of a downhole tool, the downhole tool being run into a wellbore on a wireline, and the downhole tool in the wellbore with a resettable seal set to isolate a wellbore region above the seal for fracturing or treatment.

One embodiment provides a downhole tool for use within a borehole that extends into a subterranean formation. The downhole tool comprises a resettable plug, a valve, a pressure sensor, and a valve actuator. The resettable plug includes a central body, a selectively deployable sealing element about a periphery of the central body, and a fluid passageway that extends through the central body from a first opening in the central body on a first side of the deployable sealing element to a second opening in the central body on a second side of the deployable sealing element. The valve is disposed to control fluid flow through the fluid passageway, the pressure sensor is disposed to sense fluid pressure within the borehole on the first side of the deployable sealing element, and the valve actuator is coupled to the valve for controlling operation of the valve.

The downhole tool may be connected to a wireline that extends from a wireline unit or truck located near an opening into the borehole. The wireline may be used to provide physical support of the downhole tool as it is raised and lowered into and within the borehole, supply electrical power to electronic components within the downhole tool, and/or provide for data communication between the downhole tool and control systems outside the borehole. While the wireline may be sufficient for raising and lowering the downhole tool within a substantially vertical wellbore or portion of a wellbore, a downhole tool on a wireline as a part of a BHA may further include a tractor that can push or pull the downhole tool along the borehole regardless of the orientation of the borehole, such as in a horizontal portion of a borehole.

The sealing element preferably includes one or more elastomeric rings extending about the circumference of the central body of the resettable plug. Under compression in an axial direction (i.e., a compressive force directed generally parallel to the axis of the resettable plug), the elastomeric rings press radially outwardly to engage the borehole and seal off the borehole. With the sealing element set to seal off the borehole, fluid contained in a first portion of the borehole above or uphole of the sealing element may be isolated from fluid contained in a second portion of the borehole below or downhole of the sealing element. The setting of the sealing element to isolate a first portion of the borehole from a second portion of the borehole may be useful in conjunction with various downhole processes, such as a formation fracturing or treatment operation.

The downhole tool may further include an anchor having a plurality of anchor elements, each anchor element being radially deployable to engage the borehole and inhibit unintended movement of the downhole tool along the borehole. For example, the anchor elements may be deployed or set so that the downhole tool is retained in a fixed location within the borehole even if the downhole tool is subjected to external forces. For example, the anchor elements may be deployed prior to a formation fracturing or treatment operation so that the downhole tool retains its location despite being exposed to a high pressure fracturing or treatment fluid on one side of the sealing elements. In a further example, the anchor elements may be deployed in conjunction with opening or closing a sliding sleeve disposed along a section of casing within the borehole.

The sealing element and the anchor may be independently operated using separate actuators or may be operated dependent upon a single actuator. One preferred embodiment actuates both the sealing element and the anchor using a single actuator. Furthermore, using a single actuator to actuate both the sealing element and the anchor simplifies the construction of the downhole tool and ensures that the sealing element is not set without setting the anchor. Use of the anchor helps to prevent damage to a sealing element that is sealed against the borehole.

The fluid passageway through the central body of the resettable plug extends from a first opening or port in the central body on a first side of the deployable sealing element to a second opening or port in the central body on a second side of the deployable sealing element. Optionally, the resettable plug may have a plurality of first openings or ports disposed about the central body on the first side of the deployable sealing element, such that each of the first openings or ports are angularly spaced apart about a circumference of the central body. In a similar option, the resettable plug may have a plurality of second openings or ports disposed about the central body on the second side of the deployable sealing element, such that each of the second openings or ports are angularly spaced apart about a circumference of the central body. The resettable plug may have a plurality of first openings or ports and a plurality of second openings or ports, where the number of first openings or ports may be the same as or different than the number of second openings or ports, and where the positioning or orientation of the first openings or ports may be the same as or different than the positioning or orientation of the second openings or ports.

The fluid passageway may include a generally axial passageway between the first and second openings or ports. For example, the generally axial passageway may be defined by a section of tubular metal. Furthermore, the central body of the resettable plug may include a section of tubular metal, wherein the generally axial passageway is defined by the inwardly-facing surface of the tubular metal. The cross-sectional area of the fluid passageway may vary widely, but is preferably sufficient to reduce borehole pressure differentials across the resettable plug and to enable passage of expected types of fluids and particulates that may accumulate on the resettable plug when the sealing element has been set. For example, the cross-sectional area of the fluid passageway should be sufficient to allow the free passage of fracturing or treatment fluids and particulates when the valve is open. Common treatment fluids and particulates may include, benzoic acid, naphthalene, rock salt, resin materials, waxes, polymers, sand, proppant, and ceramic materials.

However, the downhole tool may include one or more components disposed within the fluid passageway without obstructing fluid flow or particulate passage through the fluid passageway. For example, the fluid passageway may contain a cable providing electrical power to, or data communication to and with, a component that is within the fluid passageway or is located on the downhole side of the resettable plug. Specifically, a cable could supply electrical power from the wireline (on the uphole end of the downhole tool) to a an electrical motor that is within the downhole tool (on the downhole side of the sealing element and fluid passageway), as well as data communication between a computing system at the surface and an on-board controller within the downhole tool (also on the downhole side of the sealing element and fluid passageway). Alternatively, a motor and hydraulic pump and an on-board controller may be on the uphole side of the sealing element and fluid passageway. In this example, a cable through the fluid passageway may provide electrical power to another component or downhole tool, such as formation perforating guns a power tool or an actuator. As another example, the fluid passageway may include a rotary vane that is axially secured within the fluid passageway. The rotary vane may be mechanically coupled to a motor, such that the motor may drive the rotary vane to assist in fluid flow and particulate passage through the fluid passageway. Alternatively, the rotary vane may be mechanically coupled to an electrical generator to generate electrical current as the result of fluid flow and particulate passage across the vanes as it passes through the fluid passageway.

The valve is disposed to control fluid flow through the fluid passageway. The valve may be disposed at any point in the fluid passageway between the first opening or port and the second opening or port. The valve is preferably either above or below the sealing element. Most preferably, the valve is disposed on the same side of the downhole tool (relative to the sealing element) as the actuator for the sealing element and any anchor. For example, the valve may be conveniently disposed at the second opening or port. One such valve may form a sleeve with a range of motion that enables the sleeve to slide across the second opening or port. A valve actuator may be coupled to the valve and used to control the operation of the valve, such that the second opening or port may be fully open (uncovered), partially open (partially covered), or fully closed (fully covered). In embodiments where the valve includes a sleeve, the valve actuator may control the extent to which the sleeve covers the second opening or port, perhaps to control one or more operating parameters selected from a fluid flow rate through the fluid passageway, a tension on the wireline cable, a pressure on one side of the sealing element, or a differential pressure across the sealing element.

The pressure sensor is disposed to sense fluid pressure within the borehole on the first side of the deployable sealing element. It should be recognized that the location of the pressure sensor within the downhole tool may vary, so long as the pressure sensor may sense the fluid pressure within the borehole on the first side of the deployable sealing element. For example, the pressure sensor may be located just inside the first opening or port on the first side of the deployable sealing element, but the pressure sensor may also be located near the second opening or port on the second side of the deployable sealing element, so long as there is no substantial obstruction between the pressure sensor and the borehole on the first side of the deployable sealing element. In one embodiment, the first opening or port is always open and the valve selectively covers the second opening or port, such that the fluid pressure within the fluid passageway is substantially the same as the fluid pressure within the borehole on the first side of the deployable sealing element. A differential pressure across the sealing element may be determinable where a second pressure sensor is disposed to sense the fluid pressure in the borehole on a second side of the deployable sealing element.

A cable tension sensor may be included in the downhole tool in order to sense an amount of tension in the wireline cable. The cable tension sensor may be secured near and downhole of the point where the wireline cable is physically secured to a cable head of the downhole tool. For example, a tension sensor may include a component which houses a strain gauge for detecting strain in a member connecting a downhole portion of the downhole tool to an uphole portion of the downhole tool and thereby an electrical signal that indicates a level of tension in the wireline cable. In another embodiment, a tension sensor may include a three-roller system with the wireline cable passing through the rollers to cause deflection of the middle roller. A load cell coupled to the middle roller provides an electronic signal that indicates a level of tension in the wireline cable. In either embodiment, the tension signal may be transmitted to a controller that is in electronic communication with the tension sensor. In one embodiment, the controller is in electronic communication with the valve actuator for sending a control signal to the valve actuator, wherein the controller adjusts operation of the valve in response to the measured amount of tension in the wireline cable. Optionally, the valve may be fully or partially opened in order to prevent the amount of tension in the wireline cable from exceeding a tension setpoint.

An electrical current sensor may be used to sense an amount of current drawn by motor coupled to a rotary vane or impeller disposed within the fluid passageway, or to sense an amount of current produced by a generator coupled to the rotary vane. The presence of particulates in the fluid flowing through the vanes is expected to increase the amount of current required by the motor to maintain a given rotational speed, such that the amount of electrical current drawn by the motor may be calibrated to determine an amount of particulate in the fluid that passes through the fluid passageway. For example, during or after a fracturing or treatment operation, the valve and/or the motor driving the vane may be controlled to continue passing fluid through the fluid passageway until the amount of particulates has dropped below a setpoint amount of particulates. The rotary vane or impeller is preferably axially disposed within a portion of the fluid passageway.

The downhole tool may further include a controller in electronic communication with the pressure sensor for receiving a pressure signal from the pressure sensor and in electronic communication with the valve actuator for sending a control signal to the valve actuator. The controller may, for example, operate to control the operation of the valve via the valve actuator in order to maintain the pressure in the borehole above the sealing element below a setpoint pressure. The pressure control may be implemented while pumping the downhole tool into the borehole with the sealing elements retracted, during a formation fracturing or treatment operation with the sealing elements set to seal against the wall of the borehole, or after a formation fracturing or treatment operation with the sealing elements set to seal against the wall of the borehole or at any time. The controller may be an analog circuit or a digital processor, such as an application specific integrated circuit (ASIC) or array of field-programmable gate arrays (FPGAs). Accordingly, embodiments may implement any one or more aspects of control logic in the controller that is on-board the downhole tool or in a computing system that is in data communication with the controller. A computing system may be located at the surface to provide a user-interface for monitoring and controlling the operation of the downhole tool, and may be in data communication with the controller over the wireline cable.

The downhole tool may further include a controller in communication with a distributed measurement cable, which may be a fiber optic-cable, for receiving measurements such as cable temperature, temperature increase or decrease rate, vibration, strain, pressure or combinations thereof. The controller may, for example, operate to control the operation of the valve via the valve actuator in order to maintain setpoints of various measured parameters provided by the distributed measurement cable. The valve control may be implemented while pumping the downhole tool into the borehole with the sealing elements retracted, during a formation fracturing or treatment operation with the sealing elements set to seal against the wall of the borehole, or after a formation fracturing or treatment operation with the sealing elements set to seal against the wall of the borehole or at any time.

Embodiments of the downhole tool may further include a rotary brush. The rotary brush may be secured to the central body of the downhole tool on an uphole side of the sealing element. A motor may be mechanically coupled to the rotary brush to controllably rotate the brush. The rotary brush may be used to clean the inside surface of the borehole, such as an inside surface of casing, in a region where the resettable plug will be subsequently positioned and set to seal off the borehole. When the sealing element of the resettable plug is set against a clean surface, the sealing element will form a better seal and will experience less wear. In one option, the rotary brush may be rotated to assist with the removal of particulates that may have accumulated on the top (uphole) side of the sealing element, such as excess proppant that was used during a formation fracturing or treatment operation. Rotating the rotary brush may serve to loosen the particulates and enhance the flow of fluid and particulates through the fluid passageway when the valve is open. For example, the rotary brush may be driven to rotate until the amount of particulates in the fluid flowing through the fluid passage drops below some setpoint. In one embodiment, the downhole tool will further include an electrical current sensor for measuring an amount of electrical current drawn by the electric motor that drives the rotary brush. Such electrical current sensor may be in electronic communication with the controller for signaling the amount of electrical current to the controller. Since an accumulation of particulates in the borehole on top of the sealing element will cause a physical resistance to rotation of the rotary brush, an electrical current signal that exceeds an electrical current setpoint may indicate the presence of an accumulation of particulates in the wellbore around the rotary brush. Accordingly, the controller may further control operation of the valve and/or the rotary brush in response to the amount of electrical current drawn by the motor exceeding an electrical current setpoint.

The valve actuator may be an electrically powered valve actuator, but is preferably a hydraulic valve actuator. Where the valve actuator is hydraulic, the downhole tool may further include a hydraulic pump in fluid communication with the hydraulic valve actuator, and an electric motor mechanically coupled to operate the hydraulic pump. The electric motor preferably receives electrical power through a wireline cable, but may receive some or all of its electrical power from a battery within the downhole tool. Hydraulic fluid lines or passages extend from the hydraulic pump to one or more piston chambers so that the hydraulic fluid pushes the valve across the opening or port to control fluid flow through the fluid passageway. A solenoid valve may be used to control the supply of pressurized hydraulic fluid to and from each piston chamber. In one embodiment, a first piston chamber is disposed to enable the supply of pressurized hydraulic fluid to move the valve toward a closed position and a second piston chamber is disposed to enable the supply of pressured hydraulic fluid to move the valve toward an open position. The controller may control the operation of the various solenoid valves in order to position the valve at any desired position, including a fully closed position, a fully open position, and any position there between. Optionally, the valve actuator is spring biased to an open position such that by depressurizing the first piston chamber, the valve actuator moves into the open position. Where the valve actuator is electromechanical, the downhole tool may further include a roller screw and an electric motor mechanically coupled to operate the roller screw. The electric motor preferably receives electrical power through a wireline cable, but may receive some or all of its electrical power from a battery within the downhole tool. The roller screw drives a nut which is secured to an actuator sleeve and restricted in rotation, but free to move axially. The actuator sleeve is disposed to position the valve at a desired location including a fully closed position, a fully open position, and any position there between. The controller may control the number of rotations of the electrical motor, thereby precisely controlling the position of the valve.

Statements made herein referring to a component, opening or port being "above", "below", "uphole" or "downhole" relative to another component, opening or port should be interpreted as if the downhole tool or bottom hole assembly has been run into a wellbore. It should be noted that even a horizontal wellbore, or any non-vertical wellbore, still has an "uphole" direction defined by the path of the wellbore that leads to the surface and a "downhole" direction that is generally opposite to the "uphole" direction.

Another embodiment provides a method of controlling fluid flow through a resettable plug. The method comprises monitoring parameters measured by a distributed measurement cable and controlling operation of a valve to prevent the monitored parameters from exceeding a setpoint value of one or more parameters, wherein the valve controls fluid flow in a fluid passageway through the resettable plug, and wherein the fluid passageway extends from a first opening above the resettable plug to a second opening below the resettable plug.

Another embodiment provides a method of controlling fluid flow through a resettable plug. The method comprises monitoring a pressure of fluid within a borehole above the resettable plug, and controlling operation of a valve to prevent the monitored fluid pressure from exceeding a setpoint pressure, wherein the valve controls fluid flow in a fluid passageway through the resettable plug, and wherein the fluid passageway extends from a first opening above the resettable plug to a second opening below the resettable plug.

In one option, the method further includes running the resettable plug into the borehole on a wireline, wherein the operation of the valve is controlled while running the resettable plug into the borehole. For example, a bottom hole assembly including the resettable plug downhole tool may be run into the borehole accompanied by fluid flow being pumped downhole. The operation of the valve may be controlled while the downhole tool is run into the borehole toward a target formation. Optionally, the valve operation may be controlled to prevent the tension in the wireline cable from exceeding a tension setpoint. Opening the valve will tend to equalize the differential pressure across the downhole tool, such that the fluid being pumped into the borehole will place less tension on the wireline cable. Accordingly, the method may further include measuring an amount of tension in a wireline cable coupled to the central body of the resettable plug, and controlling operation of the valve to allow fluid flow through the passageway in response to the measured amount of tension in the wireline cable exceeding a tension setpoint.

Optionally, the method may further include positioning a rotary brush coupled to the central body to align the rotary brush with a target area of casing in the borehole, driving the rotary brush to clean the target area of casing, and positioning the resettable plug to align with the cleaned target area of the casing prior to setting the resettable plug within the borehole, wherein setting the resettable plug seals the resettable plug against the cleaned target area of the casing and isolates the uphole portion of the borehole from the downhole portion of the borehole. Still further, a motor may be mechanically coupled to the rotary brush to controllably rotate the brush, where the method further includes measuring an amount of electrical current draw by the motor to rotate the rotary brush in the target area of the casing at a predetermined rotational speed, and continuing to drive the rotary brush in the target area of the casing until the measured amount of electrical current draw by the motor is less than a predetermined current setpoint indicating the target area of the casing is clean, and wherein the resettable plug is positioned to align with the cleaned target area of the casing only after the measured amount of electrical current draw by the motor is less than the predetermined current setpoint.

Various embodiments may be implemented in conjunction with a formation fracturing or treatment operation. For example, the method may further include setting the resettable plug within the borehole to isolate an uphole portion of the borehole from a downhole portion of the borehole, and then pressurizing a fluid into the isolated uphole portion of the borehole to hydraulically fracture a subterranean formation above the resettable plug, wherein operation of the valve is controlled during the hydraulic fracturing or treatment of the subterranean formation. For example, operation of the valve may be further controlled to reduce an amount of treatment fluids and particulates accumulation on top of the resettable plug as a result of the hydraulic fracturing or treatment of the subterranean formation. Such fluids and particulates may be selected from benzoic acid, naphthalene, rock salt, resin materials, waxes, polymers, sand, proppant, and ceramic materials.

Additionally, operation of the valve may be controlled to prevent or mitigate accumulation of fluids and particulates on top of the resettable plug. As fluids and particulates are pumped into a formation during a fracture operation, the pumping pressure required to do so may increase as the formation can no longer receive a continuous rate of fluids and particulates. When this occurs, pressure will increase in the formation and the borehole, and fluids and particulates and debris from the borehole or formation, or combinations thereof, will have a greater likelihood of accumulation in the wellbore and on top of the resettable plug.

The controller may operate the valve to control the borehole pressure at a second setpoint pressure as may be required during a fracture operation. To fracture a formation, a sufficient pressure is required known as "break-pressure", for example, 8,000 psi. Once the formation is fractured, a reduced pressure is typically required to treat or inject proppant to the fractures known as the "prop-pressure", for example, 4,500 psi. The controller may be programmed to send a control signal to the valve actuator if a "break-pressure" is exceeded in a first pressure signal from the pressure sensor and then also limit "prop-pressure" as indicated by a second pressure signal.

The method may further include monitoring tension in a wireline cable coupled to the central body of the resettable plug, and controlling operation of the valve to allow fluid flow through the passageway in response to the measured amount of tension in the wireline cable exceeding a tension setpoint.

In addition, the method may further include driving a rotary brush secured to the central body on an uphole side of the circumferential seal, wherein a motor is mechanically coupled to the rotary brush to controllably rotate the brush, measuring an amount of electrical current draw by the motor to rotate the rotary brush at a predetermined rotational speed, continuing to drive the rotary brush, with the resettable plug set, until the measured amount of electrical current draw by the motor is less than an electrical current setpoint indicating a reduced amount of particulate accumulation on top of the resettable plug, and then unsetting the resettable plug in response to determining that the measured amount of electrical current draw by the motor is less than the electrical current setpoint.

Other embodiments of the method may include driving an impeller that is disposed in the passageway to assist fluid flow through the passageway, wherein a motor is mechanically coupled to the impeller to controllably spin the impeller. An alternative embodiment of the method may include generating electrical current with a generator mechanically coupled to an impeller disposed in the passageway, wherein the impeller drives the generator during fluid flow through the passageway. In addition, the method may further include measuring an amount of electrical current generated by the generator, and controlling operation of the valve to maintain fluid flow through the fluid passageway until the amount of electrical current is less than an electrical current setpoint indicating that the amount of particulate present in the fluid flow through the passageway has been reduced.

In another embodiment, a bottom hole assembly (BHA) may include the resettable plug downhole tool in addition to other downhole tools, for example, an anchor tool, an actuator tool, a gripping tool, a power tool and a locating tool. The actuator tool may be secured to and above the power tool. The gripping tool may be secured to and above the actuator tool. The locating tool may be secured to and above the gripping tool and also to the cable head. The power tool may be secured to and above the resettable plug downhole tool. A second power tool may be secure to and below the resettable plug tool and the anchor tool may be secured to and below the resettable plug downhole tool.

In an embodiment, the power tool may be a hydraulic power tool disposed to provide hydraulic power to actuate an extendable portion of the actuator tool and to the gripping tool, through the extendable portion of the actuator tool, to radially engage gripping elements of the gripping tool to a tubular within the borehole. Optionally, the power tool may be an electromechanical power tool and disposed to provide mechanical power to an extendable portion of the actuator.

Where the power tool is hydraulic, the power tool may include a hydraulic pump in fluid communication with a hydraulic reservoir, and an electric motor mechanically coupled to operate the hydraulic pump. The electric motor preferably receives electrical power through a wireline cable, but may receive some or all of its electrical power from a battery within the BHA. A hydraulic fluid line or channel extends from the hydraulic pump to a solenoid valve block which may control the supply of pressurized hydraulic fluid to and from multiple hydraulic lines or channels exiting the power tool. A controller may control the operation of various solenoid valves of the solenoid valve block in order to direct hydraulic fluid to a desired hydraulic fluid line or channel exiting the power tool.

In an embodiment, the actuator tool comprises a piston secured or integral to the extendable portion and isolating a first and second piston chamber; a first piston chamber disposed to receive pressurized hydraulic fluid to linearly actuate the extendable portion of the actuator; and a second piston chamber disposed to receive hydraulic fluid to retract the extendable portion of the actuator; wherein the first and second piston chambers controllably receive pressurized hydraulic fluid from a power tool. Optionally, a compression spring is within the second piston chamber to push the piston, thereby retracting the extendable portion of the actuator. Optionally, the actuator tool may be a rotary actuator tool that converts rotational force into a linear movement of the extendable portion.

In an embodiment, the gripping tool comprises a piston secured or integral to a radially extendable gripping element and isolating a first and second piston chamber; a first piston chamber disposed to receive pressurized hydraulic fluid to actuate or extend the radially extendable gripping element; and a second piston chamber disposed to receive hydraulic fluid to retract the radially extendable gripping element; wherein the first and second piston chambers selectively receive pressurized hydraulic fluid from a power tool and through the actuator tool. Optionally, a compression spring may be disposed within the second piston chamber to push the piston, thereby retracting the extendable portion of the actuator. In a further option, the gripping tool may receive pressurized hydraulic fluid directly from a power tool.

In an embodiment, the anchor tool comprises a piston disposed to interact with a radially extendable member and isolating a first and second piston chamber; a first piston chamber disposed to receive pressurized hydraulic fluid to actuate the radially extendable member; and a second piston chamber disposed to receive hydraulic fluid to retract the extendable member; wherein the first and second piston chambers selectively receive pressurized hydraulic fluid from a power tool. Optionally, a compression spring may be disposed within the second piston chamber to push the piston, thereby retracting the radially extendable member. In a further option, the anchor tool may receive pressurized hydraulic fluid directly from a power tool.

In an embodiment, the anchor tool radially extendable member engages a borehole to secure the BHA within the borehole.

In an embodiment, the locating tool is a casing collar locating tool.

In an embodiment, the locating tool is a mechanical locating tool.

In an embodiment, the locating tool is a wireline tool.

In an embodiment, the locating tool is an electromagnetic induction tool.

In an embodiment, radially extendable gripping elements engage a moveable closure cover selectively blocking or unblocking one or more ports of a ported tubular segment to enable delivery of a treatment fluid to a formation through the ported tubular segment.

In an embodiment, the movable closure cover selectively blocks or unblocks one or more ports of a ported tubular segment by rotation about a predominantly coaxial axis to the borehole axis.

In an embodiment, there is a method of delivering a hydraulic fracturing or treatment fluid into a subterranean formation intersected by a borehole, the method comprising the steps of deploying the bottom hole assembly into the borehole on a wireline; utilizing the locating tool to locate a ported tubular segment within the borehole; positioning the bottom hole assembly near the ported tubular segment such that the resettable plug is below and near the ported tubular segment; activating the resettable plug downhole tool to engage the borehole, deploy the selectively deployable sealing element isolating an uphole portion of the borehole from a downhole portion of the borehole and secure the bottom hole assembly within the borehole; extending the actuator tool inside the ported tubular segment; engaging a closure cover over the ported tubular segment with one or more gripping tool radially extendable gripping elements; manipulating the actuator tool to open the closure cover over the openings of the ported tubular segment; pumping a hydraulic fracturing or treatment fluid through the borehole to the ported tubular segment.

In an embodiment, the method further comprises controlling operation of the valve while running the bottom hole assembly into the borehole.

In an embodiment, the method further comprises controlling operation of the valve during the delivery of the hydraulic fracturing or treatment fluid to the subterranean formation.

In embodiment, the method further comprises controlling operation of the valve to reduce an amount of fluid or particulate accumulation on top of the resettable plug as a result of the pumping of the hydraulic fracturing or treatment operation of the subterranean formation.

In an embodiment, the method further comprises monitoring pressure of the hydraulic fracturing or treatment fluid above the deployed selectively deployable sealing element; upon the pressure reaching a setpoint pressure, controlling operation of the valve to prevent the fluid pressure from exceeding the setpoint pressure, wherein the valve only controls fluid flow through the fluid passageway.

In an embodiment, the pumping step further comprises pressurizing the fluid into the isolated uphole portion of the borehole to hydraulically fracture or treat the subterranean formation above the resettable plug.

In an embodiment, the operation of the valve is controlled during the hydraulic fracturing or treatment of the subterranean formation.

In an embodiment, the method further comprises deactivating the resettable plug; repositioning the bottom hole assembly within the borehole without removing the bottom hole assembly from the borehole; reactivating the resettable plug within the borehole to isolate a second uphole portion of the borehole from a second downhole portion of the borehole; pumping a hydraulic fracturing or treatment fluid into the borehole that extends into the subterranean formation; pressurizing the hydraulic fracturing or treatment fluid into the isolated second uphole portion of the borehole to hydraulically fracture or treat the subterranean formation above the resettable plug.

Another embodiment provides a method of delivering a treatment fluid into a formation intersected by a borehole, the method comprising the steps of: deploying the bottom hole assembly (BHA) into the borehole on a wireline, utilizing a locating tool to locate a ported tubular segment within the borehole; positioning the BHA near the ported tubular segment such that the resettable plug downhole tool is below and near the ported tubular segment; activating the resettable plug downhole tool to engage the borehole and secure the BHA within the borehole; extending the actuator tool inside a ported tubular segment; engaging a closure cover over the ported tubular segment with the gripping tool radially extendable gripping elements; retracting the actuator tool to open the closure cover over the openings of the ported tubular segment; retracting the gripping tool radially extendable gripping elements; retracting an extendable portion of the actuator tool; closing the valve of the resettable plug downhole tool; delivering a treatment fluid through the borehole to the ported tubular segment; opening the valve in the resettable plug downhole tool to remove debris from above the resettable plug to below the resettable plug; and deactivating the resettable plug downhole tool.

Yet another embodiment provides a method of delivering a treatment fluid into a formation intersected by a borehole, the method comprising the steps of: deploying a BHA into the borehole on a wireline, utilizing the locating tool to locate a ported tubular segment within the borehole; positioning the BHA near the ported tubular segment such that the resettable plug downhole tool is below and near the ported tubular segment; engaging a radially extendable member of the anchor tool to the borehole; activating the resettable plug downhole tool to engage the borehole and secure the BHA within the borehole; extending the actuator tool inside the ported tubular segment; engaging a moveable closure cover over the ported tubular segment with the gripping tool radially extendable gripping elements; retracting the actuator tool to move the closure cover and unblock the openings of the ported tubular segment; retracting the gripping tool radially extendable gripping elements; retracting the extendable portion of actuator tool; closing the valve of the resettable plug downhole tool; delivering a treatment fluid through the borehole to the ported tubular segment; opening the valve of the resettable plug downhole tool to remove debris from above the resettable plug to below the resettable plug; deactivating the resettable plug downhole tool; and retracting the radially extendable member of the anchor tool.

In an embodiment, an extendable portion of the actuator tool may be retracted to open the closure cover over the openings of ported tubular segment.

In an embodiment of a bottom hole assembly (BHA), the resettable plug tool is connected to a cable head, the power tool may be connected below the resettable plug downhole tool, the anchor tool may be connected below the power tool, the actuator tool may be connected below the anchor tool, the gripping tool may be connected below the actuator tool and the locating tool may be connected below the gripping tool.

In an embodiment, there is provided a method of delivering a treatment fluid into a formation intersected by a borehole, the method comprising the steps of: deploying a BHA into the borehole on wireline, utilizing the locating tool to locate a ported tubular segment within the borehole; positioning the BHA near the ported tubular segment such that the resettable plug downhole tool is above and near the ported tubular segment; engaging a radially extendable member of the anchor tool to the borehole; extending the actuator tool inside a ported tubular segment; engaging a closure cover over the ported tubular segment with the gripping tool radially extendable gripping elements; retracting the actuator tool to open the closure cover over the openings of the ported tubular segment; retracting radially extendable gripping elements of the gripping tool; retracting the radially extendable member of the anchor tool; repositioning the BHA such that the resettable plug downhole tool is below and near the ported tubular segment; engaging the radially extendable member of the anchor tool to the borehole; activating the resettable plug downhole tool to engage the borehole; closing the valve of the resettable plug downhole tool; delivering a treatment fluid through the borehole to the ported tubular segment; opening the valve of the resettable plug downhole tool to remove debris from above the resettable plug to below the resettable plug; deactivating the resettable plug downhole tool; and retracting the radially extendable member of the anchor tool.

In an embodiment, the closure cover is opened by an integrated actuation mechanism. For example, a motor disposed to rotate or shift the closure cover.

In an embodiment, the closure cover is opened by a communication line extending uphole.

In an embodiment, the closure cover is opened by an electronic means.

It is noted that the BHA, downhole tools and components, and the ported tubular segments discussed herein, are provided as examples of suitable embodiments for opening variously configured downhole ports. Numerous modifications are contemplated and will be evident to those reading the present disclosure.

FIGS. 1A-C are diagrams of a bottom hole assembly (BHA) 10 (FIG. 1A), the BHA being run into a wellbore on a wireline (FIG. 1B), and the BHA in the wellbore with a resettable seal set to isolate a wellbore region above the seal for fracturing or treatment (FIG. 1C). In reference to FIG. 1A, the BHA 10 is shown with a resettable plug downhole tool 12 coupled to a wireline cable 14 by a cable head 16. Furthermore, the resettable plug downhole tool 12 has an upper connection 13 that could be used to couple with any number and type of additional downhole tools or components deemed suitable to support a given downhole process or objective. The resettable plug downhole tool 12 includes a deployable sealing element 20 and an anchor 22 disposed about the periphery of a central body 18. In the embodiment shown, the sealing element 20 includes three elastomeric rings 21 along the length of the sealing element 20, and the anchor 22 includes a plurality of anchoring elements 23 spaced apart about the periphery of the central body 18.

The central body 18 includes a fluid passageway (not shown; see FIGS. 2A-2B and 3A-3B) that extends through the central body 18 from a first opening or port 44 in the central body on a first (upper/uphole) side of the deployable sealing element to a second opening or port 46 in the central body on a second (lower/downhole) opposing side of the deployable sealing element 20. The BHA 10 further includes a power tool 28 that houses various solenoid valves, motors, pumps, or controllers needed to support the operation of the resettable plug. Furthermore, the power tool 28 has a distal connection 29 that could be used to couple with any number and type of additional downhole tools or components deemed suitable to support a given downhole process or objective. For example, the downhole tool 10 may include a set of perforating guns (not shown) coupled to the connection 29. The discussion of FIGS. 2A-2B and FIGS. 3A-3B, below provides a more detailed description of the resettable plug 12 and the operation of the deployable sealing element 20, the anchor 22, and a valve disposed to control fluid flow through the fluid passageway.

In FIG. 1B, the BHA 10 is disposed in a borehole 30 with the wireline cable 14 coupling the downhole tool 10 to a truck or unit (not shown) at the surface above the borehole 30. The wireline cable 14 may provide physical support to the downhole tool 10, supply electrical power to the downhole tool, and enable data communication between the downhole tool and a computing system 32 at the surface above the borehole. The arrow 34 illustrates an uphole direction and the arrow 36 illustrates a downhole direction defined by the borehole pathway to the surface.

In FIG. 1C, the BHA 10 has been run into the borehole 30 to a location where the sealing element 20 of the resettable plug 12 is below a target subterranean formation 38. In this location, the sealing element 20 is set in order to seal each of the individual elastomeric sealing elements 21 against the wall of the borehole 30, where the wall is typically an inside surface of a metal casing string. With the sealing element 20 sealed within the borehole 30, the region of the borehole above or uphole of the sealing element 20 is fluidically isolated from the region of the borehole below or downhole of the sealing element 20. With the sealing element 20 and anchor 22 set against the borehole 30 wall, a formation fracturing or treatment operation may be performed on the formation 38 by supplying a fracturing or treatment fluid into the formation 38 at a high pressure and high flow rate. The fracturing or treatment fluid may include one or more of benzoic acid, naphthalene, rock salt, resin materials, waxes, polymers, sand, proppant, and ceramic materials. During the fracturing or treatment operation, fluids and particulates may accumulate on the upper surface of the sealing element 20. However, this accumulation of particulate may damage the sealing element 20 when the sealing element is retracted to an unset condition and/or when the resettable plug with retracted sealing element is relocated within the borehole. Additionally, pumping into the borehole 30 to flush accumulated particulate downhole in an annular space created by the retracted sealing element 20 and the borehole 30 wall, may damage the sealing element 20. The resettable plug 12 of the BHA 10 may be used to manage or remove the accumulation of fluids and particulates on the upper surface of the sealing element 20 to prevent damage to the sealing element 20.

FIG. 2A-2B and FIG. 3A-3B are cross-sectional views of the BHA 10 having a fluid passageway 40 extending through a resettable plug 12 and having a valve 42 for controlling fluid flow through the fluid passageway 40. The downhole tool 10 has a cable head 16 at its proximal (uphole) end for securing the wireline cable 14 (see also FIGS. 1A-1C). The wireline cable 14 may include a physical support line, an electrical power supply line, and a data communication line. The physical support line, such as a braided metal cable, may terminate at the cable head 16, but the electrical power supply line and data communication line extend through the central body 18 to reach one or more motors and one or more controllers or sensors. Accordingly, the electrical power supply line and data communication line may extend through an optional central conduit 19A, an optional conduit 19B secured to the inner wall of the central body 18, or through a passage 19C within the walls of the central body 18.

The central body 18 is preferably a rigid tubular metal, which may be described as having a central axis 17. The central body 18 has one or more openings or ports 44 near a first (upper) end and one or more openings or ports 46 near a second (lower) end. As shown, the first openings or ports 44 may remain open at all times, whereas the second openings or ports 46 are selectively opened or closed by the valve 42. The central body 18 also supports the sealing element 20, including one or more circumferential elastomeric rings 21. Such elastomeric rings 21 are compressible and expand radially outwardly in all directions under axially directed compression. The central body 18 may also support an anchor 22, which includes a plurality of anchoring elements 23 spaced apart around the circumference of the central body 18. The anchor elements 23 may be pushed outwardly to engage a borehole wall (as shown in FIG. 1C) and temporarily secure the downhole tool 10 in a fixed location within the borehole. In the embodiment shown in FIGS. 2A-2B and 3A-3B, the sealing element 20 and the anchor 22 share an actuator, but the valve 42 has its own actuator. It should be recognized that the sealing element 20 and the anchor 22 could each also have their own actuator, if desired.

Proceeding downward along the downhole tool 10, the central body 18 is coupled to the power tool 28 (in the form of a hydraulic module) that houses various solenoid valves, motors, pumps, or controllers needed to support the operation of the resettable plug. It should be recognized that the arrangement or configuration of the various components may vary from the embodiment shown. In the illustrated embodiment, the power tool 28 includes a motor 50 that drives a gearbox 52 coupled to a hydraulic fluid pump 54 by a drive shaft 53.

The hydraulic fluid pump 54 supplies hydraulic fluid at a high pressure through a supply line 55 to first and second solenoid valves 60, 62. The first solenoid valve 60 controls the flow of hydraulic fluid to a first piston chamber 61 that retracts an actuator 70. Conversely, the second solenoid valve 62 controls the flow of hydraulic fluid to a second piston chamber 63, and an optional supplemental piston chamber 63B, that extends the actuator 70. With the actuator 70 retracted, the seal 20 and anchor 22 are also retracted (not set), such that the downhole tool 10 may be moved within the borehole. With the actuator 70 extended, the sealing element 20 and the anchor 22 are both set, such that the anchor 22 is biased outwardly to grip the borehole 30 wall and the elastomeric rings 21 of the sealing element 20 are compressed and outwardly deformed to seal against the borehole 30 wall (see FIG. 1C).

Figure 2A:
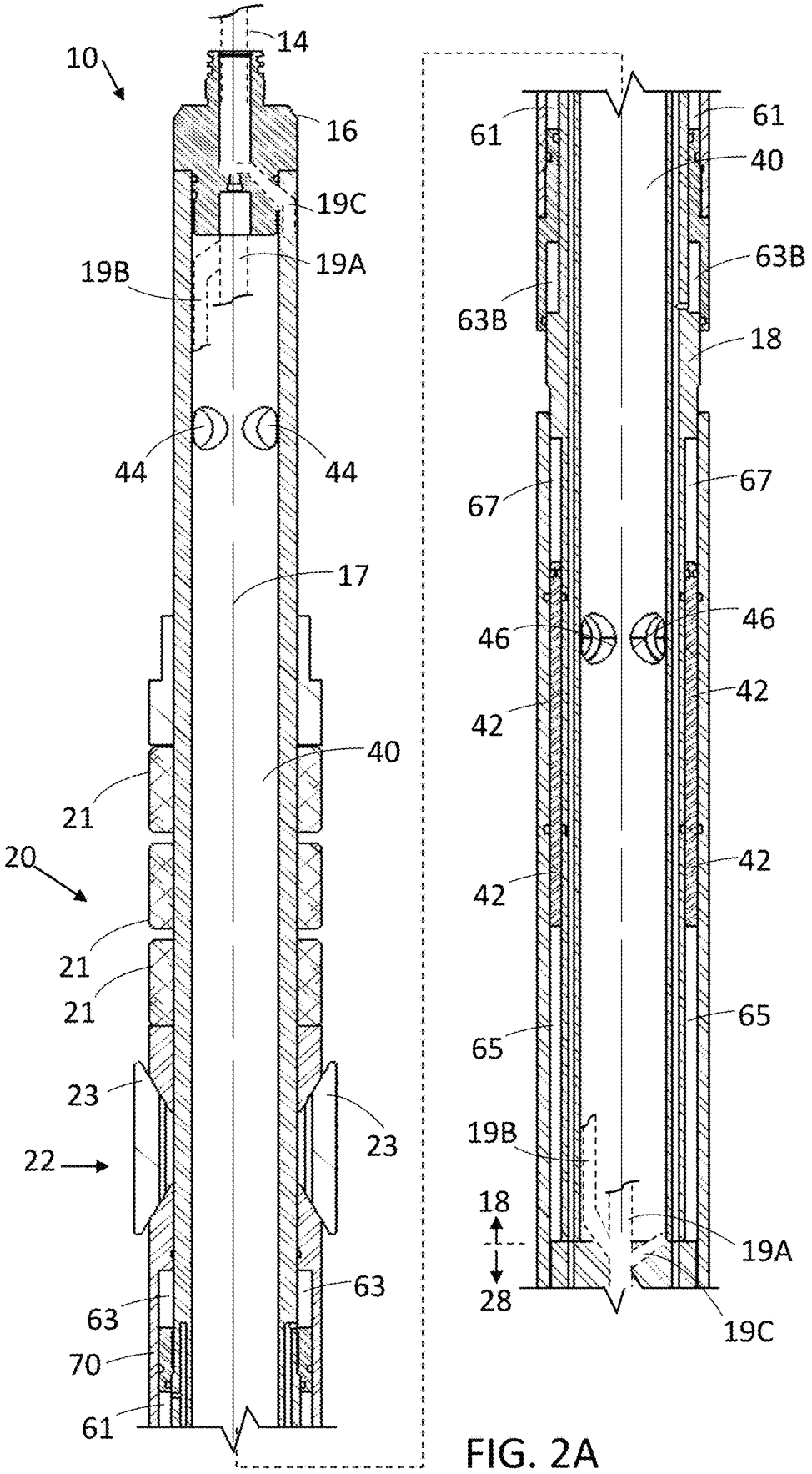
FIGS. 2A and 2B are cross-sectional partial views of a downhole tool having a fluid passageway extending through a resettable seal and having a valve for controlling fluid flow through the fluid passageway.
Figure 2B:
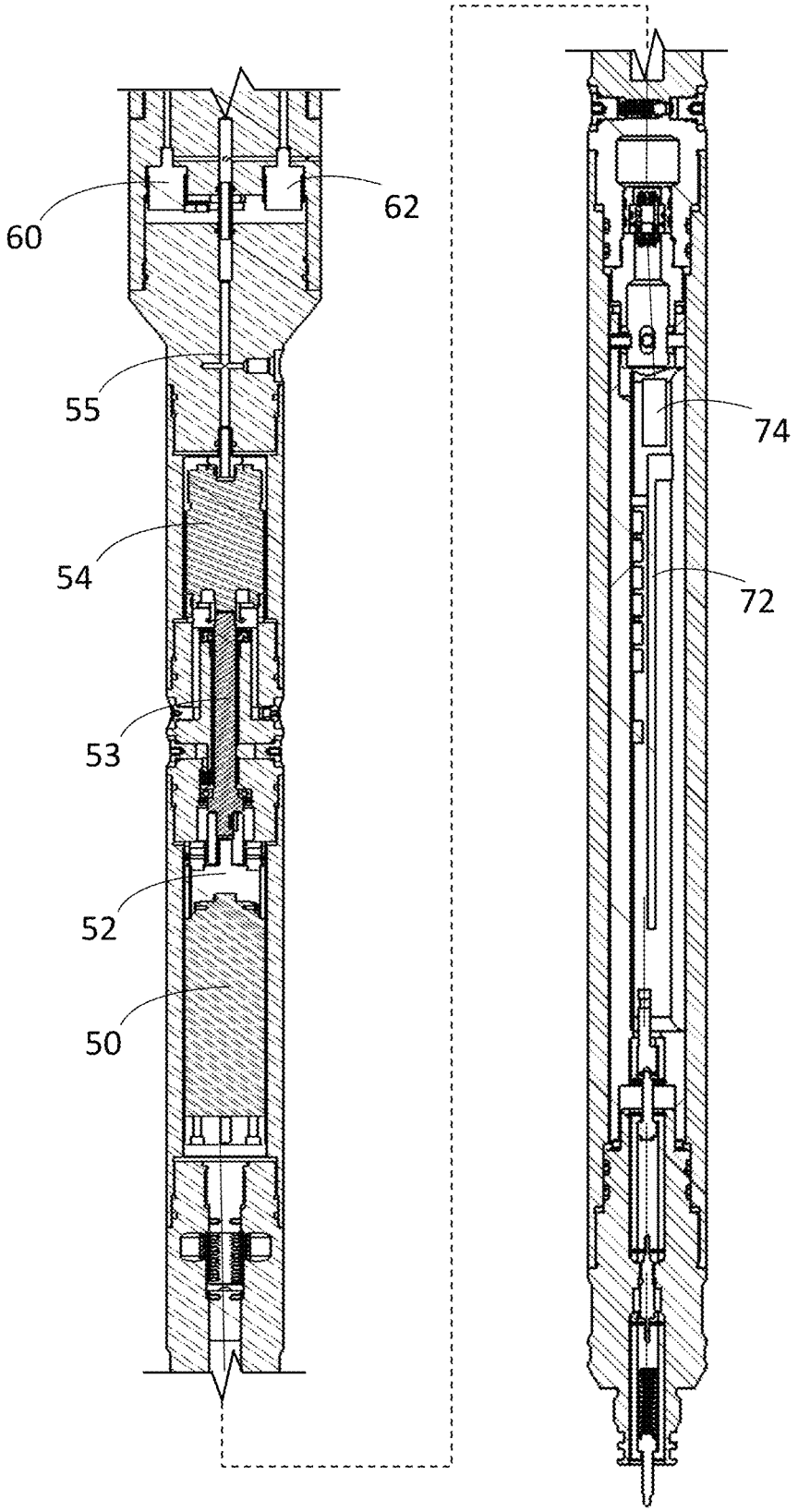
Figure 3A:
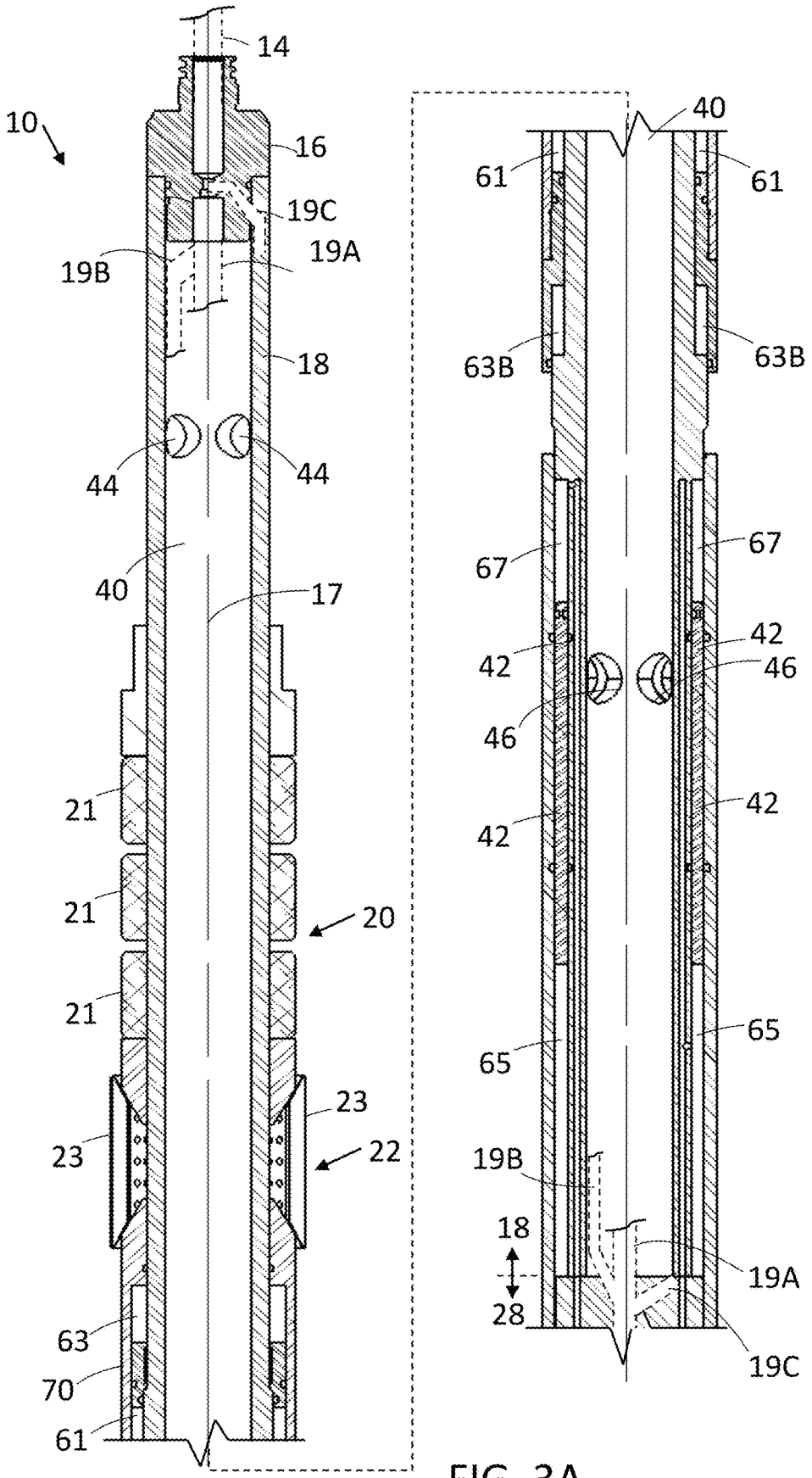
FIGS. 3A and 3B are cross-sectional partial views of a downhole tool having a fluid passageway extending through a resettable seal and having a valve for controlling fluid flow through the fluid passageway.
Figure 3B:
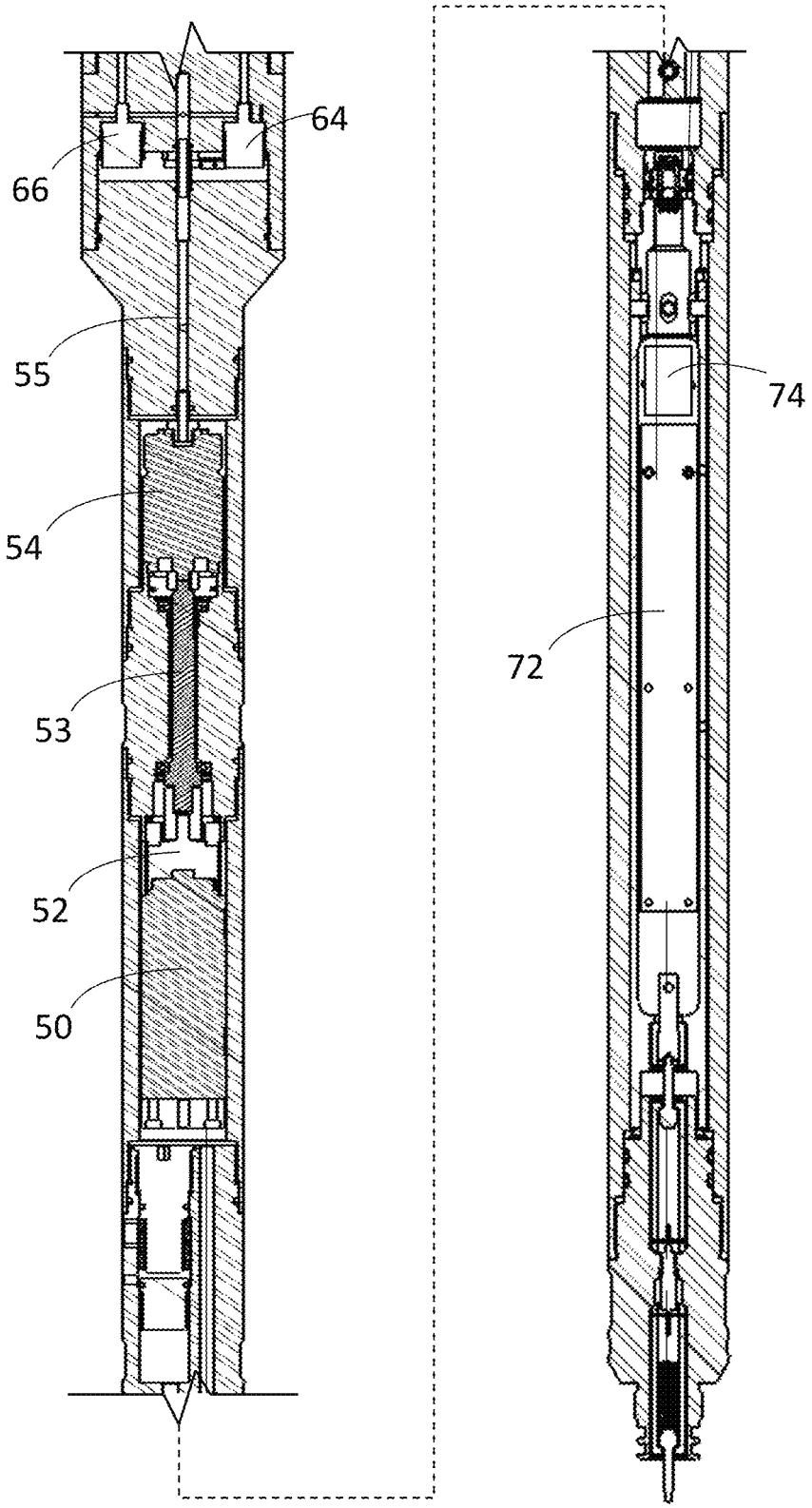

The cross-sectional view of FIG. 3A-3B is taken through the BHA 10 after rotating the BHA 10 a quarter turn (i.e., 90 degrees of rotation) about the central axis 17 relative to the cross-sectional view of FIG. 2A-2B. As shown in FIG. 3A-3B, the hydraulic fluid pump 54 also supplies hydraulic fluid at a high pressure through the supply line 55 to third and fourth solenoid valves 64, 66. The third solenoid valve 64 controls the flow of hydraulic fluid to a third piston chamber 65 that moves the valve 42 upward to cover the openings or ports 46. Conversely, the fourth solenoid valve 66 controls the flow of hydraulic fluid to a fourth piston chamber 67 that moves the valve 42 downward to uncover the openings or ports 46. Further description of the valve operation is provided in reference to FIG. 9.

Figure 15:
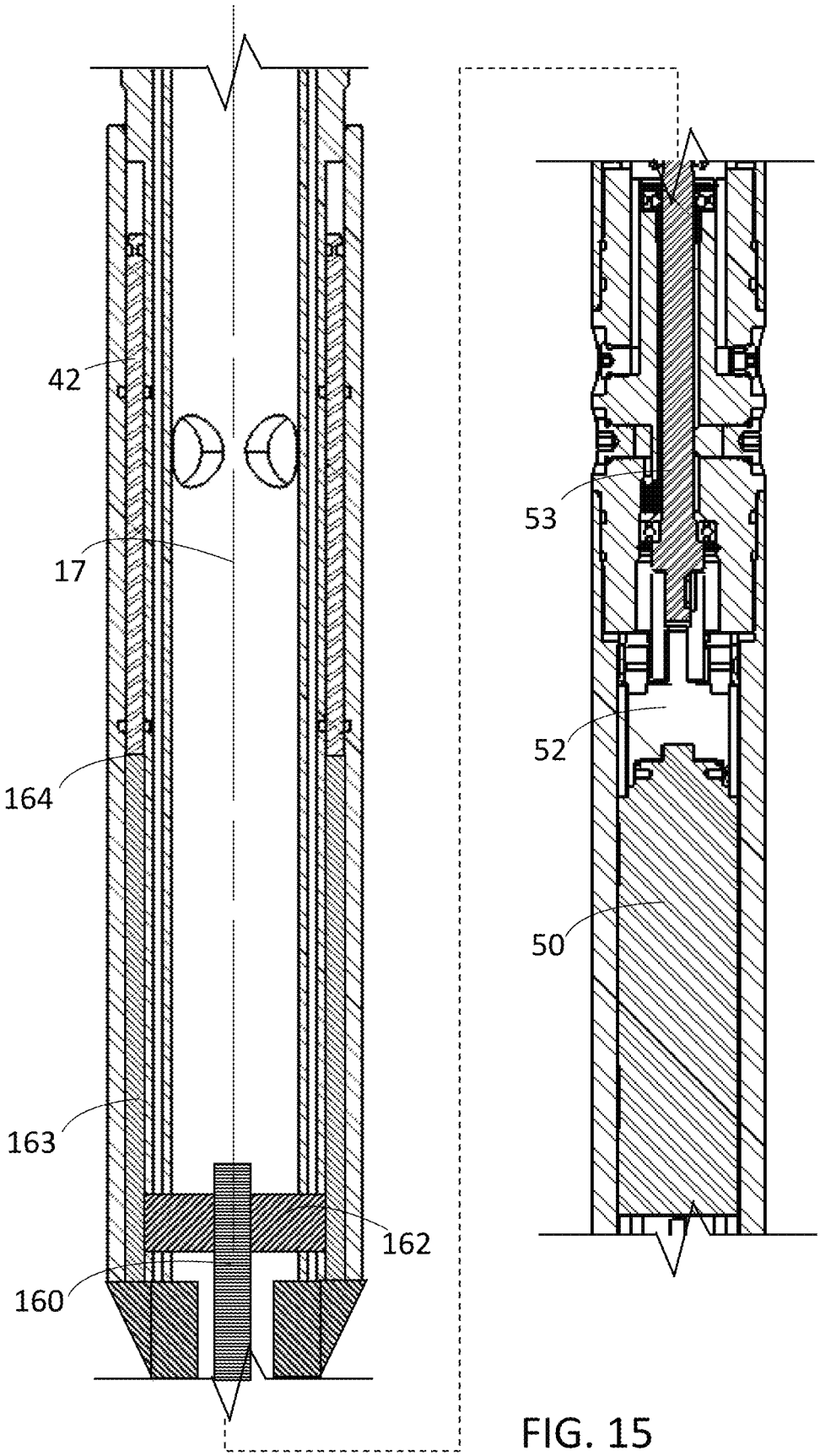
FIG. 15 is a partial section view of a downhole tool having a resettable seal and an electro-mechanically actuated flow-through valve.

Optionally in FIG. 15, an electrical motor 50 powers a drive shaft 53 which is disposed to power a roller screw 160. The roller screw 160 drives a roller screw nut 162, which is secured to an actuator sleeve 163 and is prevented to rotate in rotation about central axis 17, but free to move axially. The actuator sleeve 163 is disposed at interface 164 to position the valve 42 at a desired position including a fully closed position, a fully open position, and any position there between. The electric motor 50 preferably receives electrical power through a wireline cable 14, but may receive some or all of its electrical power from a battery 74 within the downhole tool. The controller 72 may control the number of rotations and rotational direction of the electrical motor 50, thereby precisely controlling the position of the valve 42.

The wireline cable 14 may provide an electrical power supply line to the motor 50 and a controller 72. Alternatively, the BHA 10 may include a battery 74 that provides electrical power to the motor 50 and controller 72. The controller 72 is responsible for control of the motor 50, the solenoid valves 60, 62 that operate the sealing element 20 and the anchor 22, and the solenoid valves 64, 66 that operate the valve. The controller 72 may implement control logic that is based, without limitation, on one or more inputs, such as a pressure sensor signal, a wireline cable tension signal, an electrical current sensor signal, or a control command received through the wireline cable 14.

Figure 4:
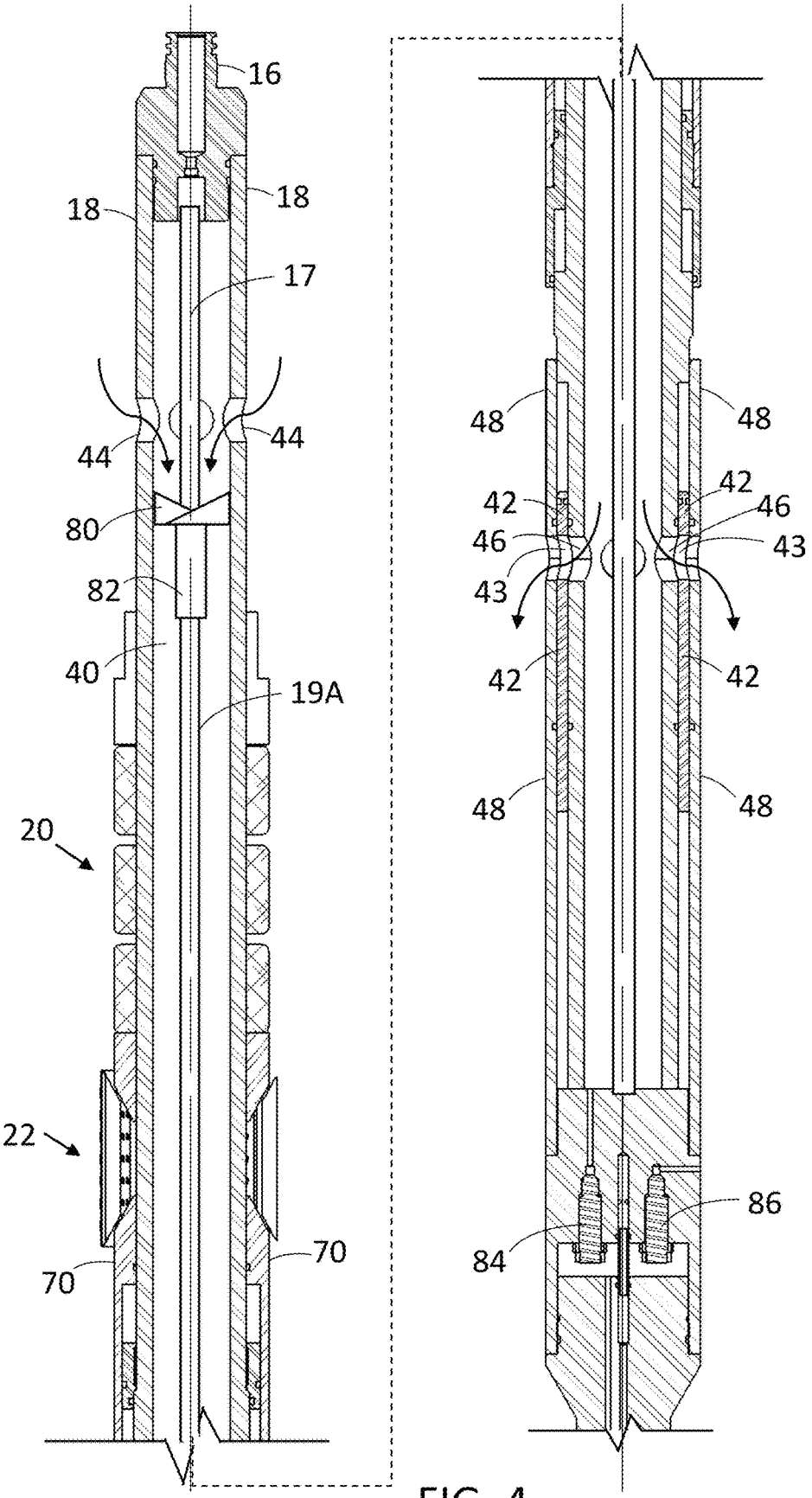
FIG. 4 is a cross-sectional view of the fluid passageway including a rotary vane disposed in the fluid passageway.
Figure 5:
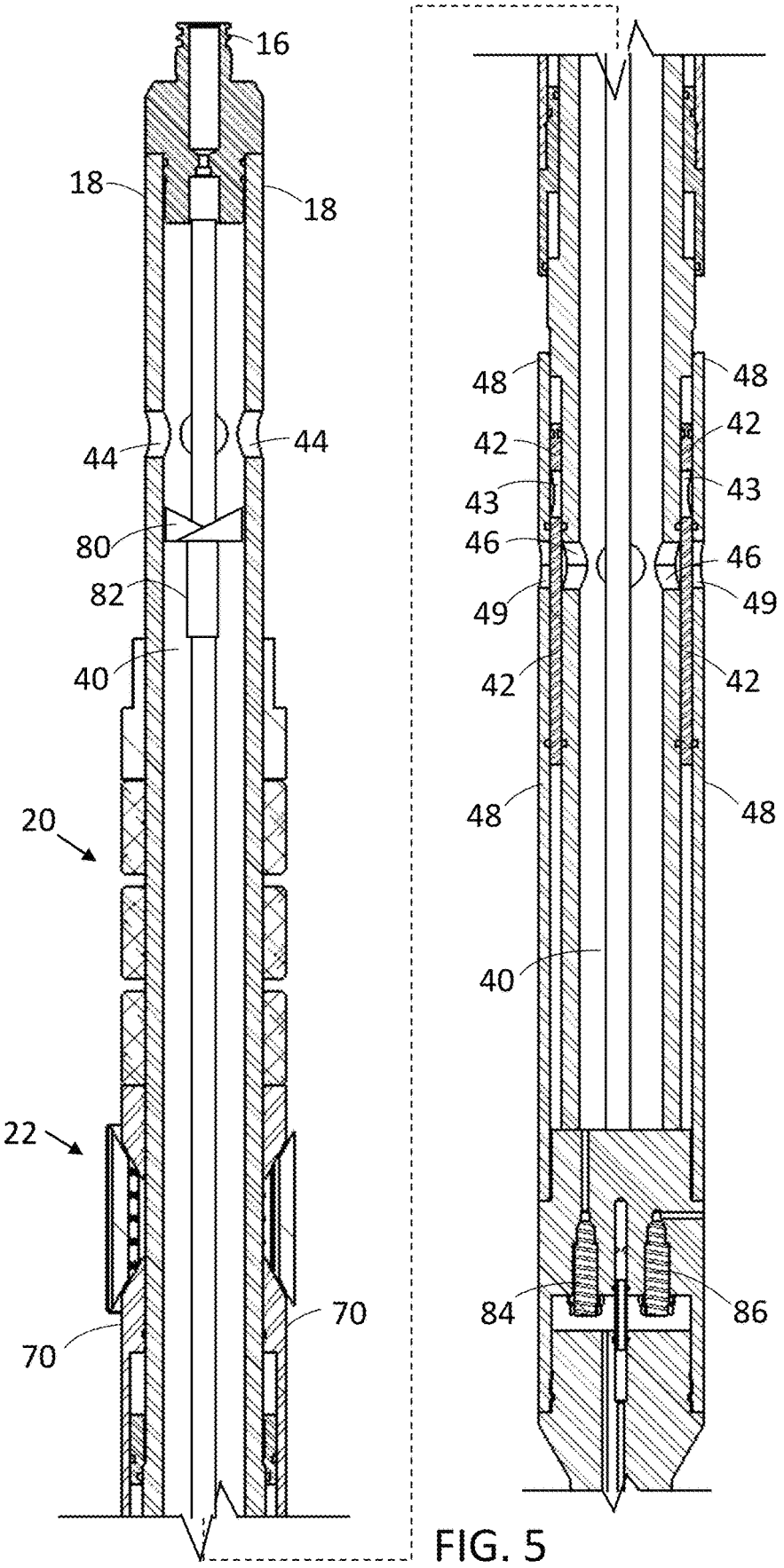
FIG. 5 is a cross-sectional view of the fluid passageway including a rotary vane disposed in the fluid passageway.

FIGS. 4 and 5 are cross-sectional views of an embodiment of the BHA 10 including a resettable plug downhole tool 12 that has a rotary vane 80 disposed in the fluid passageway 40. The rotary vane 80 is secured for rotation about the axis 17 of the central body 18. The rotary vane 80 is coupled to a member 82, which may be either a motor or an electrical generator depending upon the embodiment. The motor may be connected to an electrical supply and to control lines through a central conduit 19A or otherwise.

FIGS. 4 and 5 also illustrate an optional position of first and second pressure sensors 84, 86 within the BHA 10. The first pressure sensor 84 is in fluid communication with the fluid passageway 40, which is always open to the borehole fluid above the sealing element 20 in embodiments where the openings or ports 44 are always open. By contrast, the second pressure sensor 86 is in fluid communication with the fluid in the borehole below the sealing element 20. Although the pressure sensors are directly physically adjacent each other, the first and second pressure sensors 84, 86 sense the borehole fluid pressure on opposing sides of the sealing element 20 due to the configuration of the fluid passageway 40 through the central body 18. When the valve 42 is closed (i.e., covers the openings or ports 46), the difference in the pressure sensed by the first pressure sensor may differ greatly from the pressure sensed by the second pressure sensor. This is particularly true when the downhole tool 10 is being run into the borehole under fluid pumping pressure, and when the sealing element 20 is set and a fracturing or treatment operation is being performed above the sealing element. FIGS. 4 and 5 are substantially similar views, except that the valve 42 is in an open condition in FIG. 4 and is in a closed condition in FIG. 5. Embodiments may control the operation of the valve 42 to achieve a variable position of the valve 42 and vary the extent of flow through the openings or ports 46. As shown, the valve 42 may have its own openings 43 that are controllably aligned with the openings or ports 46 to allow fluid flow between the fluid passageway 40 and the borehole below the sealing element 20. In FIG. 5, the valve 42 has been moved upward such that the openings 43 are misaligned from the openings 46 and the valve 42 is in a closed condition. In the embodiments shown, the central body 18 includes a further support structure 48 outside the valve 42 to support the valve 42. The optional further support structure 48 has its own opening 49 to facilitate fluid flow when the valve 42 is in the open condition.

Figure 6A:
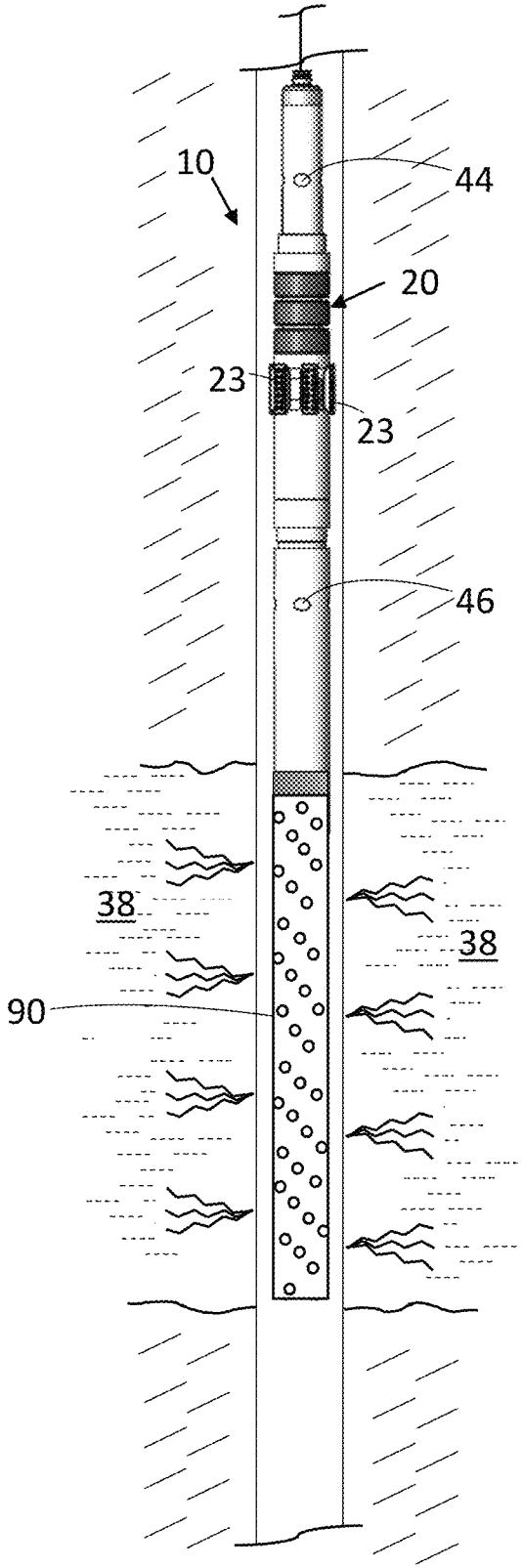
FIG. 6A is a schematic diagram of a downhole tool positioned so that a set of perforating guns are aligned with a target formation for perforating a region of the casing that leads to the target formation.

FIG. 6A is a schematic diagram of the BHA 10 positioned so that a set of perforating guns 90 are aligned with a target formation 38 for perforating a region of the borehole 30 wall (casing) that leads to the target formation. Optionally, the sealing element 20 and anchor 22 may be set to center the perforating guns 90 within the borehole prior to perforating the borehole wall.

Figure 6B:
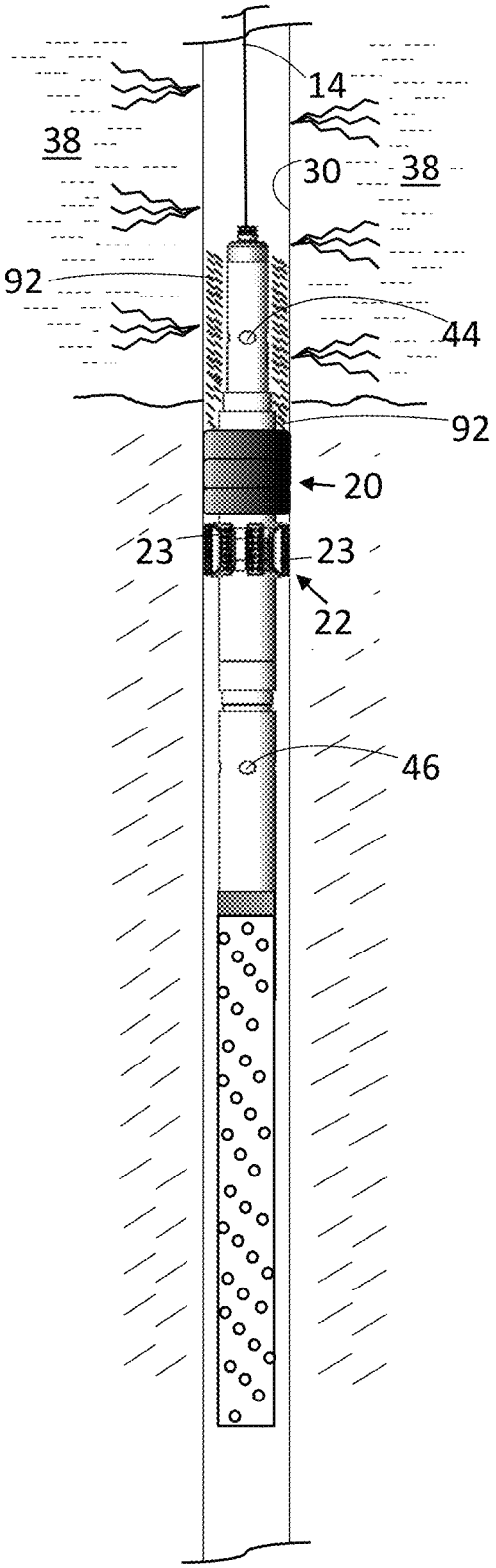
FIG. 6B is a schematic diagram of the downhole tool of FIG. 6A after being repositioned so that the resettable seal is set to seal the wellbore below the perforated casing, such as prior to a formation fracturing or treatment operation.

FIG. 6B is a schematic diagram of the BHA 10 of FIG. 6A after being repositioned (lowered) so that the sealing element 20 is set to seal the wellbore below the perforated casing in the target formation 38, such as prior to a formation fracturing or treatment operation. During the fracturing or treatment operation, a fracturing or treatment fluid is made to flow into the target formation 38 at a high pressure and flow rate. After a region of the borehole wall is perforated and/or fractured, the tool may be positioned to a second region for a second (and additional) perforation and/or fracture operation(s) without bringing the downhole tool out of the borehole. The fracturing or treatment operation may impose large differential pressures across the sealing element 20 and may lead to an accumulation of particulate 92 on top of the sealing element 20. Embodiments disclosed above are able to sense the pressure above and/or below the sealing elements and relieve some or all of that pressure by controlling operation of the valve. Other embodiments disclosed above are able to determine the presence of accumulated particulate, or particulate within fluid flowing through the fluid passageway when the valve is opened or open, and control operation of the valve to remove the particulate accumulation prior to unsetting the sealing element 20.

Figure 7:
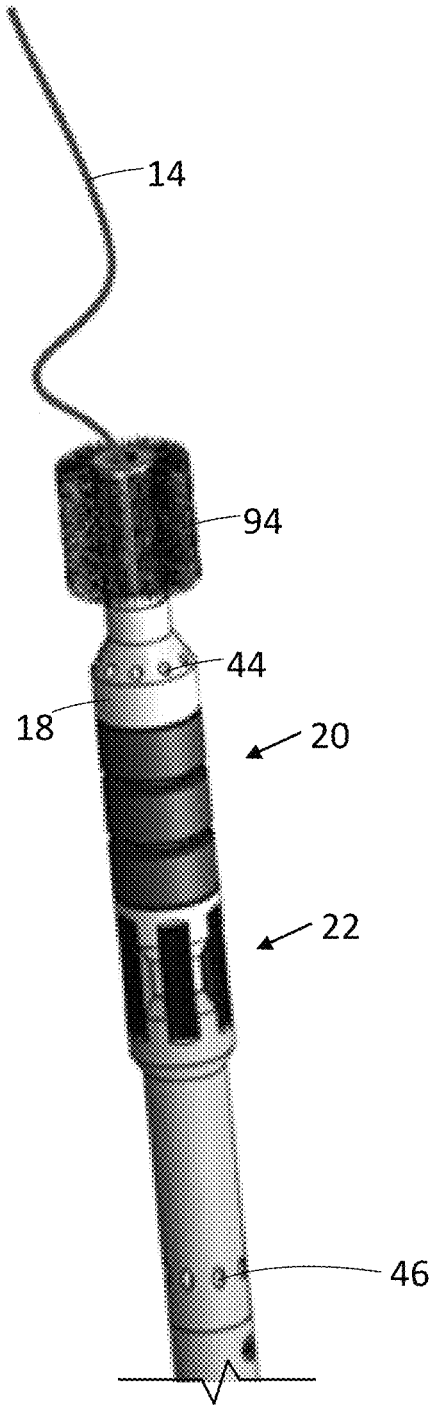
FIG. 7 is a partial perspective view of a downhole tool having a rotary brush disposed uphole of the resettable seal and flow-through valve.

FIG. 7 is a partial perspective view of the BHA 10 having a rotary brush 94 disposed uphole of the sealing element 20 and the upper openings or ports 44 to the fluid passageway. The rotary brush 94 may be driven by an electric motor, either to clean a surface of the borehole wall in an area where the sealing element 20 and/or anchor 22 is to be set, or to "stir" accumulated particulates 92 (see FIG. 6B), or otherwise facilitate the flow of particulate, so that the particulate will flow with the borehole fluid into the upper openings 44, through the fluid passageway in the central body 18, and out the lower openings 46 to the borehole below the sealing element 20. The electrical current drawn by the rotary brush motor may be measured and used for control purposes, wherein the amount of electrical current drawn may be representative of the amount of particulate accumulated around the rotary brush 94.

Figure 8A:
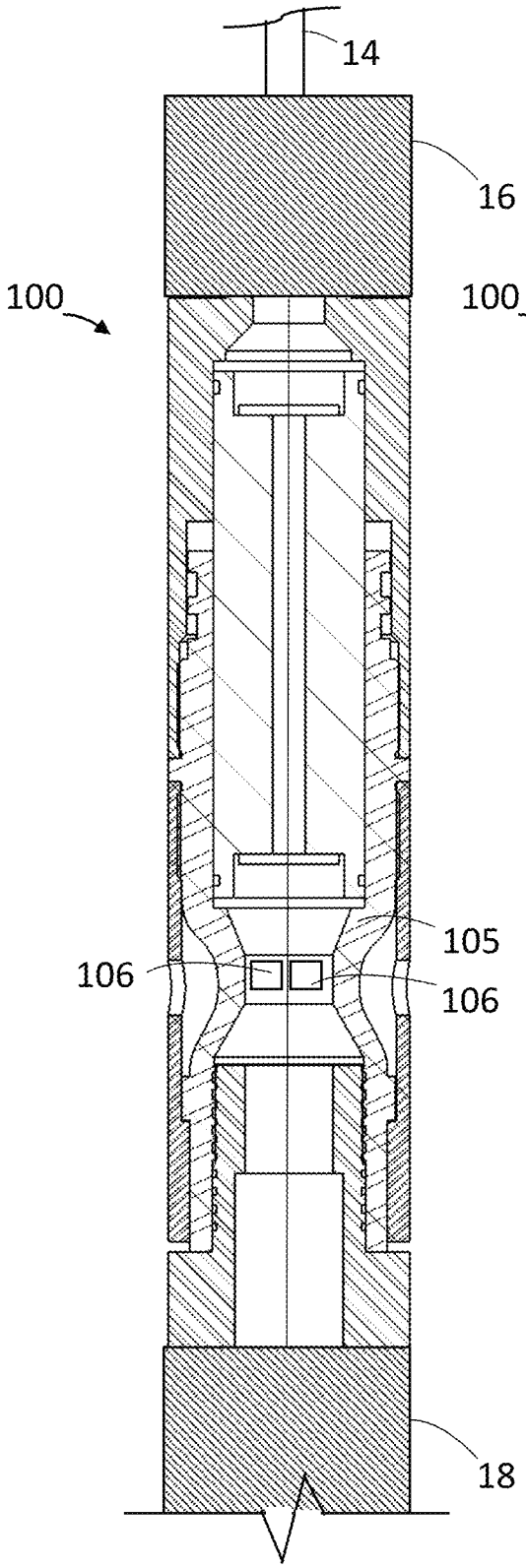
FIGS. 8A and 8B are cross-sectional views of a tension sensor unit that may be coupled to the uphole end of a downhole tool for measuring the tension in the wireline that is coupled to the downhole tool.

FIG. 8A is a cross-sectional view of a tension sensor unit 100 that may be coupled to the cable head 16 at the uphole end of the BHA 10 for measuring an amount of tension in the wireline cable 14 that is coupled to the BHA. The cable tension sensor may be secured near and downhole of the point where the wireline cable is physically secured to a cable head 16 of the BHA. The tension sensor may include a gauge component 105 which houses strain gauges 106 for detecting strain in the gauge component 105 that connects the central body 18 to the cable head 16. The strain gauges 106 may then provide an electronic signal that indicates a level of tension in the wireline cable. The tension signal may be transmitted to a controller that is in electronic communication with the tension sensor. In one embodiment, the controller is in electronic communication with the valve actuator for sending a control signal to the valve actuator, wherein the controller adjusts operation of the valve in response to the measured amount of tension in the wireline cable. Optionally, the valve may be fully or partially opened in order to prevent the amount of tension in the wireline cable from exceeding a tension setpoint during a fracturing or treatment operation or during running the BHA into the borehole.

Figure 8B:
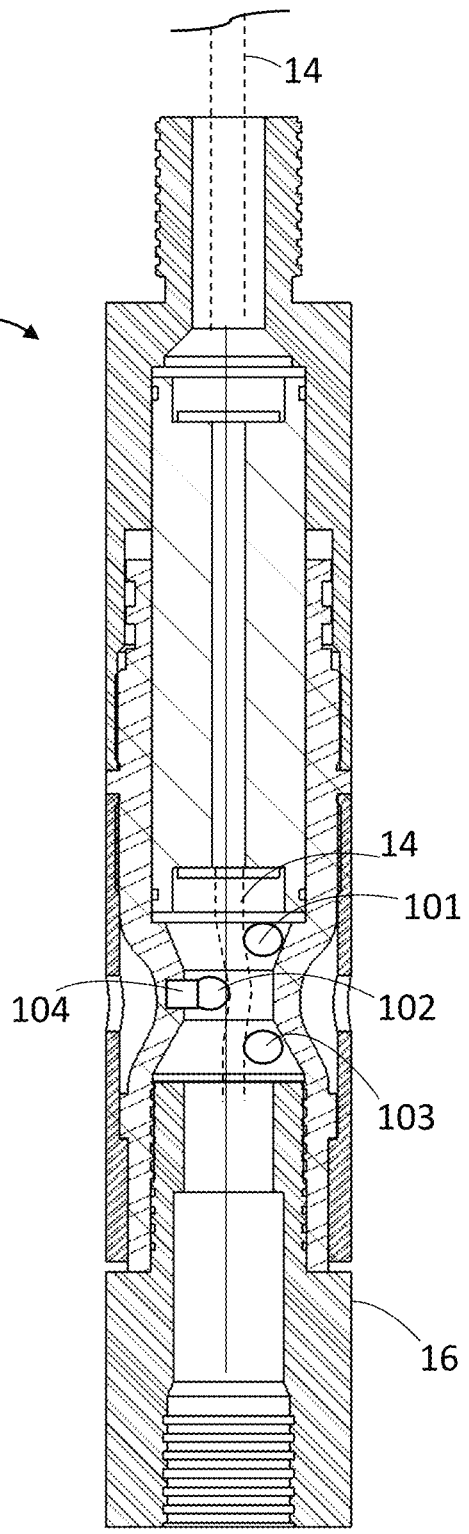

Optionally, as shown in FIG. 8B, the cable tension sensor unit 100 may be secured to the BHA 10 proximate (uphole) of the point where the wireline cable 14 is physically secured to a cable head 16 of the BHA. For example, the tension sensor unit 100 may include a three-roller system with the wireline cable 14 passing through the rollers to cause deflection of the middle roller. In a preferred arrangement, the cable 14 engages a first roller 101, a second roller 102, and a third roller 103, with the first and third rollers 101, 103 on one side of the cable 14 and the second (middle) roller 102 on an opposing side of the cable 14. Furthermore, the second (middle) roller 102 should be positioned so that the cable 14 is made to deflect toward the side of the first and third rollers. Accordingly, tension in the cable 14 results in a lateral force on the second roller 102 that can be measured by a load cell (or strain gauge) 104. The load cell may then provide an electronic signal that indicates a level of tension in the wireline cable. The tension signal may be transmitted to a controller that is in electronic communication with the tension sensor. In one embodiment, the controller is in electronic communication with the valve actuator for sending a control signal to the valve actuator, wherein the controller adjusts operation of the valve in response to the measured amount of tension in the wireline cable. Optionally, the valve may be fully or partially opened in order to prevent the amount of tension in the wireline cable from exceeding a tension setpoint.

Figure 9:
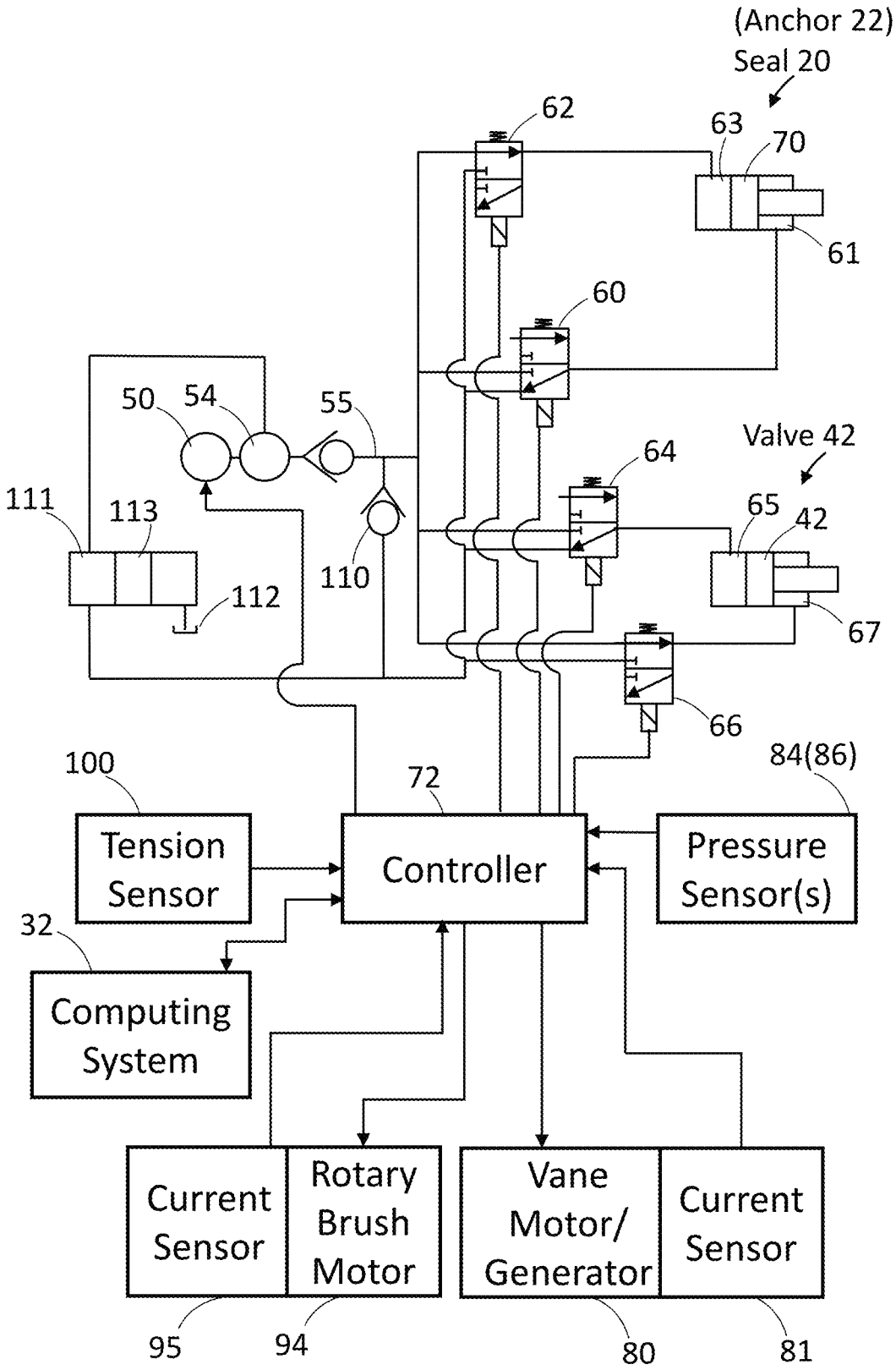
FIG. 9 is a schematic diagram of a control system for controlling operation of the seal and the valve of the downhole tool.

FIG. 9 is a schematic diagram of a control system for controlling operation of the sealing element 20 and the valve 42 of the resettable plug downhole tool. While the diagram shows the on-board controller 72 as the only controller, the computing system 32 (see also FIG. 1B) on the uphole end of the wireline cable may perform some or all of the functions attributed here to the on-board controller 72. Furthermore, the computing system 32 may provide control signals to the on-board controller 72 indicating when the downhole tool should initiate certain processes, such as setting the sealing element 20 and anchor 22 prior to a fracturing or treatment operation, or unsetting the sealing element 20 and anchor 22 prior to moving the downhole tool within the borehole.

However, in the embodiment shown, the controller 72 may receive inputs from the tension sensor 100, the pressure sensor(s) 84 and/or 86, the current sensor 95 associated with the motor of the rotary brush 94, the current sensor 81 associated with the motor or generator of the vane 80, and the computing system 32. Additional sensors and inputs may be incorporated as well. The controller 72 may provide output signals to various components of the BHA, such as the motor 50 coupled to the hydraulic pump 54, such as the motor 50 coupled to the roller screw 160, the motor of the rotary brush 94, the motor of the vane 80, and each of the solenoid valves 60, 62, 64, 66 that control the operation of the sealing element 20, the anchor 22 and the valve 42.

In the current condition of the solenoid valves in FIG. 9, pressurized hydraulic fluid is supplied by the hydraulic pump 54 and applied via solenoid valve 66 to the piston chamber 67, and the solenoid valve 64 is allowing hydraulic fluid from the piston chamber 65 to drain off to the downhole tool sump volume 111, such that the valve 42 moves (downward) to the open condition, the downhole tool sump volume 111 being pressure balanced to the wellbore pressure 112 by compensation piston 113 Also, pressurized hydraulic fluid is being applied via solenoid valve 62 to the piston chamber 63, and the solenoid valve 60 is allowing hydraulic fluid from the piston chamber 61 to drain off to the downhole tool sump volume 111, such that the actuator 70 moves (upward) to the set the sealing element 20 (and the anchor 22). A pressure relief valve 110 may be provided in fluid communication with supply line 55 to regulate the fluid pressure in the hydraulic control system to a pre-selected maximum pressure.

The disclosed apparatus and methods enable flushing the wellbore before, during and after a fracturing or treatment operation, such that the resettable plug is not trapped/buried by particulate in the borehole and the sealing element is not damaged. By flowing the particulate through the fluid passageway within the central body of the resettable plug downhole tool, the particulate may be removed from the top of the sealing element before the sealing elements are unset. This avoids the usual damage, such as erosion, to the sealing elements that is caused by particulate flowing across the surface of the sealing elements. Embodiments of the apparatus and methods will prolong the life of the sealing element and, thereby, maximize the number of times that the resettable plug can be successfully set downhole. The valve is also useful during setting of the resettable plug, since the valve may be open during the setting of the sealing element and then closed after the sealing element has been set. Having the valve open in this manner while setting the sealing element may prevent pressure or flow from shifting the BHA during the setting process. Still further, in pump-down operations, high fluid velocities around the downhole tool may erode and damage the sealing elements. By having the flow-through valve open during a pump-down operation, higher pump rates may be tolerated without damage to the sealing elements.

Figure 10A:
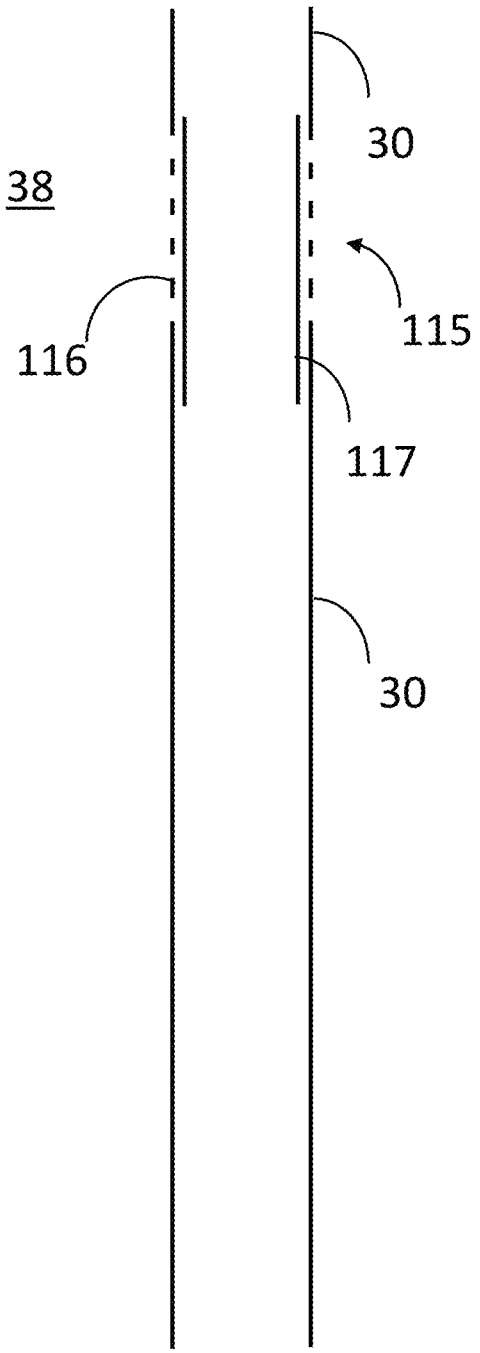
FIG. 10A is a schematic diagram of a sliding sleeve in the closed position.
Figure 10B:
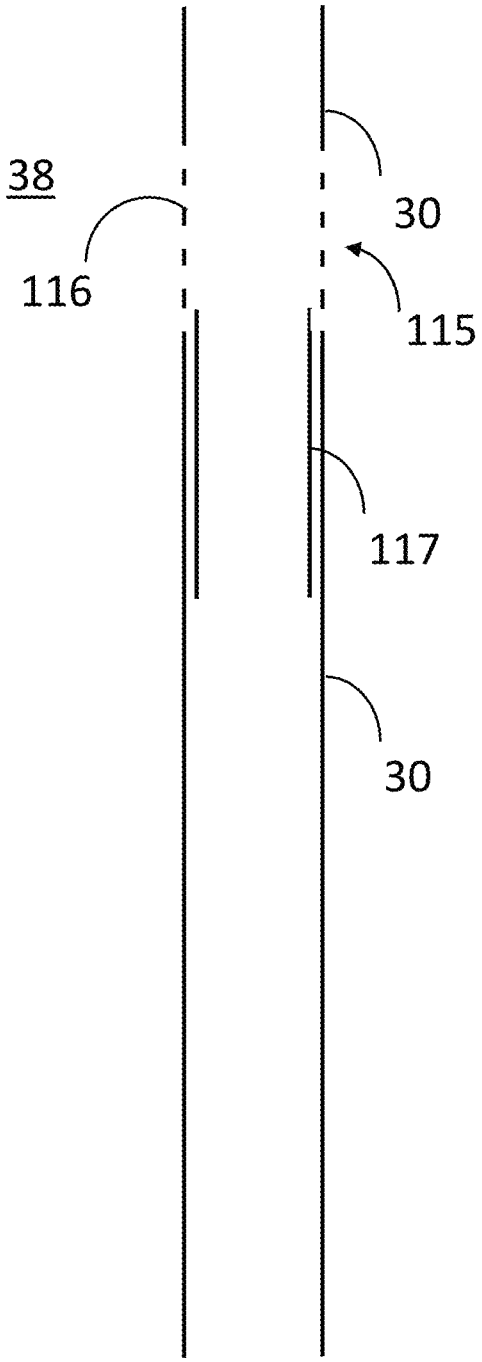
FIG. 10B is a schematic diagram of a sliding sleeve in the open position.

FIG. 10A is a schematic of a borehole 30 with a ported tubular section 115, intersecting a subterranean formation 38. The ported tubular ports 116 are covered and blocked by closure cover 117 to prevent flow from the borehole 30 to the formation 38, and from the formation 38 to the borehole 30. In FIG. 10B, the closure cover 117 is an open position allowing flow through ports 116.

Figure 11:
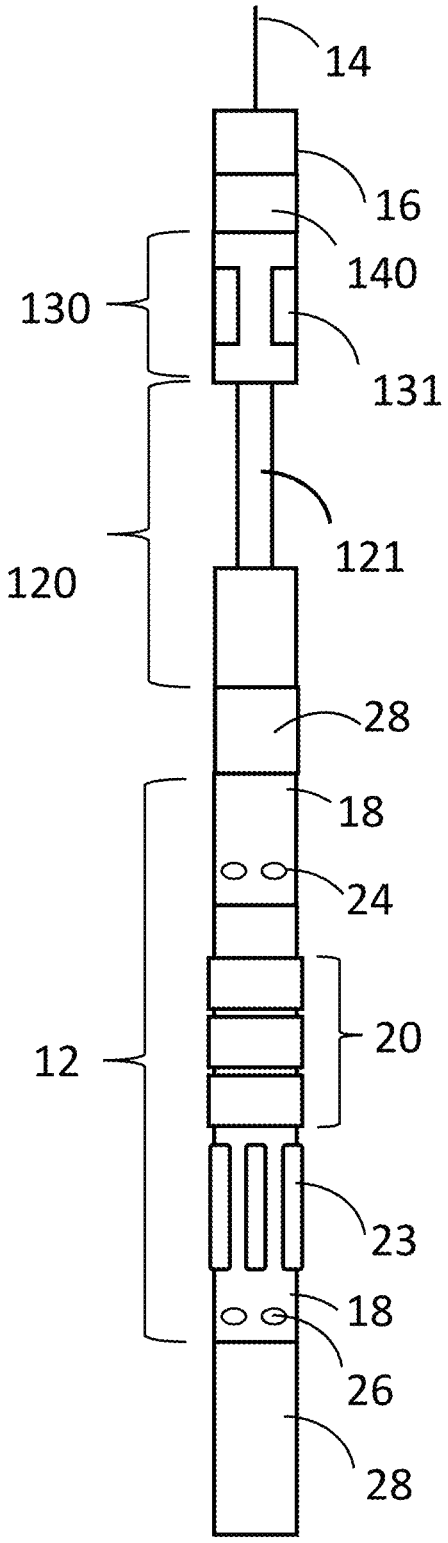
FIG. 11 is a schematic diagram of a bottom hole assembly that may used in a downhole operation, where the resettable plug is positioned below an actuator tool.

FIG. 11 is a schematic of a preferred embodiment of a BHA including, from uphole to downhole, a cable head 16 coupled to a wireline cable 14, a locating tool 140, a gripping tool 130 with radially extendable gripping elements 131, connected to and above an extendable portion 121 of an actuator tool 120, a first power tool 28, a resettable plug downhole tool 12, and a second power tool 28.

Figures 12A, 12B, 12C:
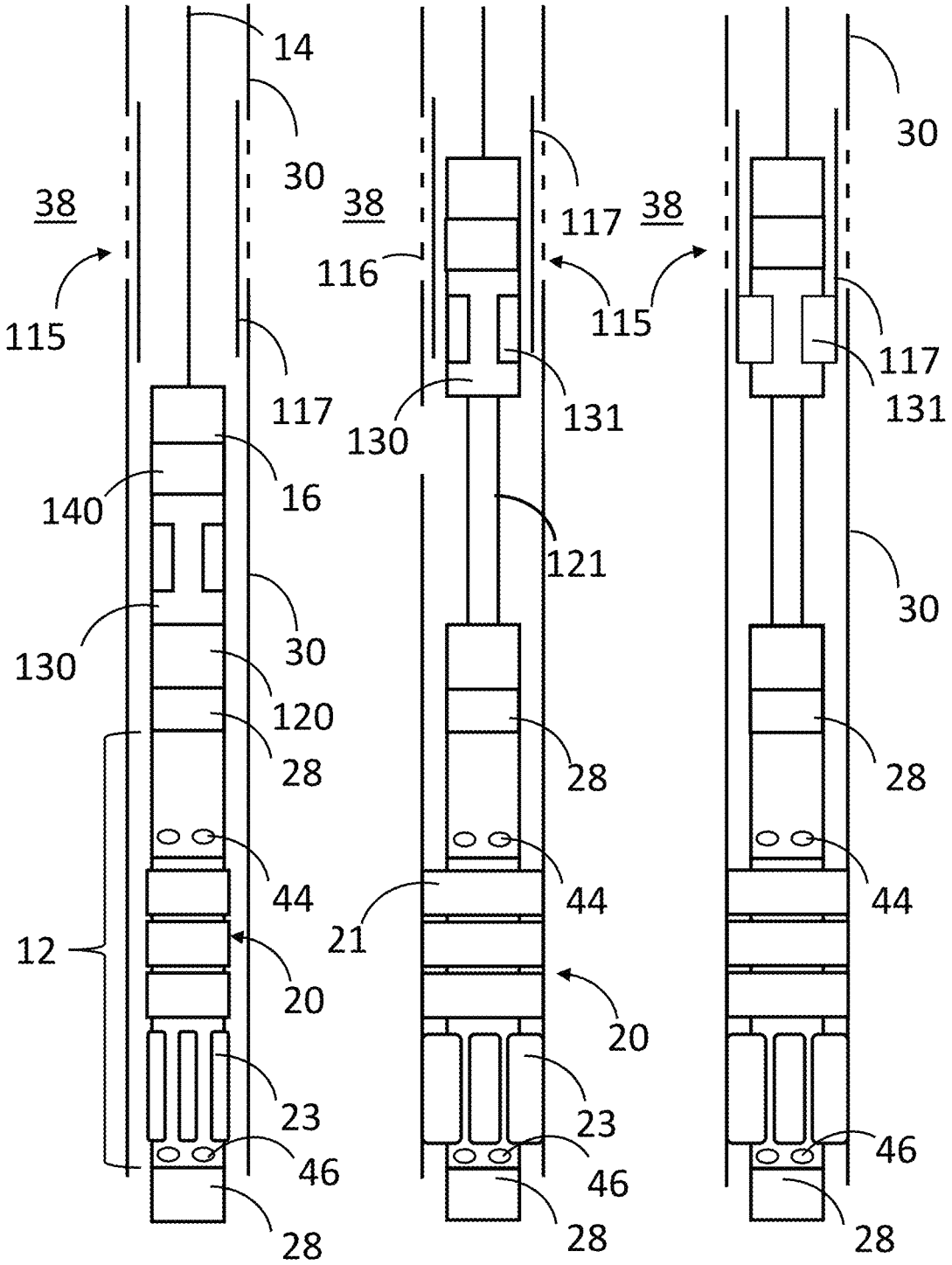
FIG. 12A-12F are schematic diagrams of a BHA depicting steps of a downhole operation which includes the opening of a ported tubular segment and isolating portions of the borehole utilizing the BHA of FIG. 11.

FIG. 12A through FIG. 12F are schematic diagrams of the BHA of FIG. 11 at various states of a downhole operation. In FIG. 12A, the locating tool 140 locates the ported tubular section 115 within the borehole 30 and the BHA is positioned below ported tubular section 115 such that closure cover 117 is within reach of the gripping tool 130 secured to the extendable portion of the actuator 120.

In FIG. 12B, the resettable plug downhole tool 12 receives hydraulic power from the lower power tool 28 and is activated to set sealing element 20 and anchor elements 23 to the borehole 30. Extendable portion 121 of actuator 120 is extended with hydraulic power provided by the upper power tool 28, to position the gripping tool 130 within the closure cover 117.

In FIG. 12C, the gripping tool 130 receives hydraulic power from the upper power tool 28 through the actuator 120, extendable portion 121 to extend radially extendable gripping elements 131 of the gripping tool 130 to engage the closure cover 117.

Figure 12D:
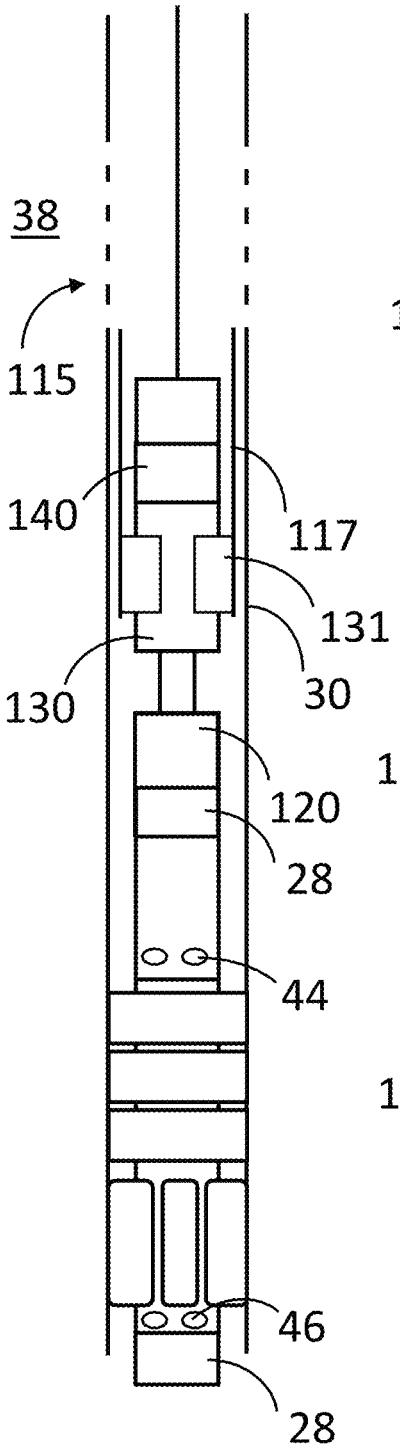

In FIG. 12D, the extendable portion 121 of the actuator 120 is retracted, thereby moving closure cover 117 to the open position as in FIG. 10B.

Figure 12E:
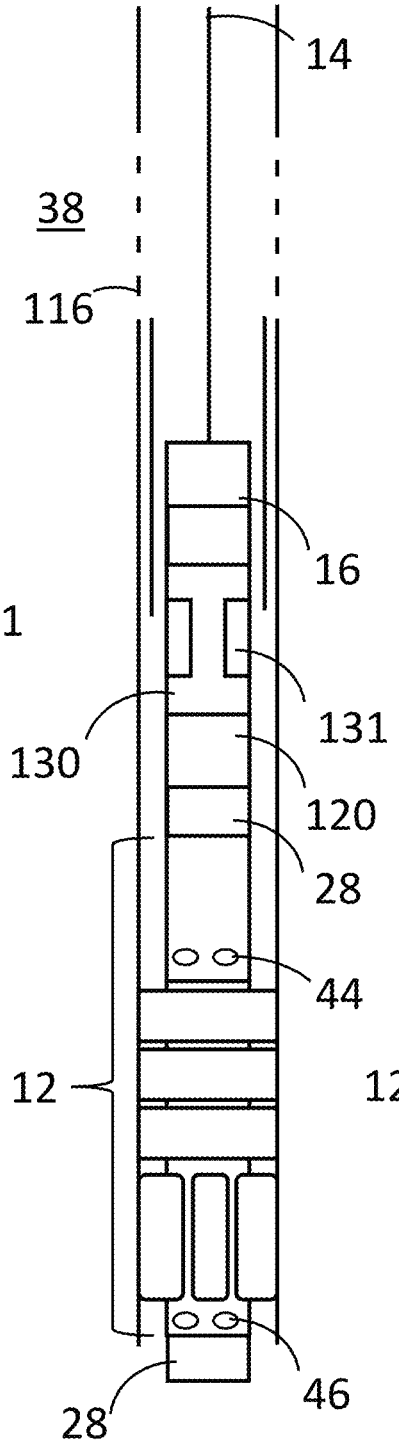

In FIG. 12E, the radially extendable gripping elements 131 are retracted with hydraulic power from the upper power tool 28, and with reference to FIG. 5 of the resettable plug downhole tool 12, the valve 42 is moved upward with power from lower power tool 28, such that the openings 43 are misaligned from the openings 46 and the valve 42 is put in a closed condition. A fracture or treatment operation may now commence through ports 116 to formation 38. The valve 42 may be controlled during the fracture or treatment operation. After the fracture or treatment operation, the valve 42 is moved downward with power from lower power tool 28, such that the openings 43 are aligned with openings 46 and the valve 42 is put in an open position.

Figure 12F:
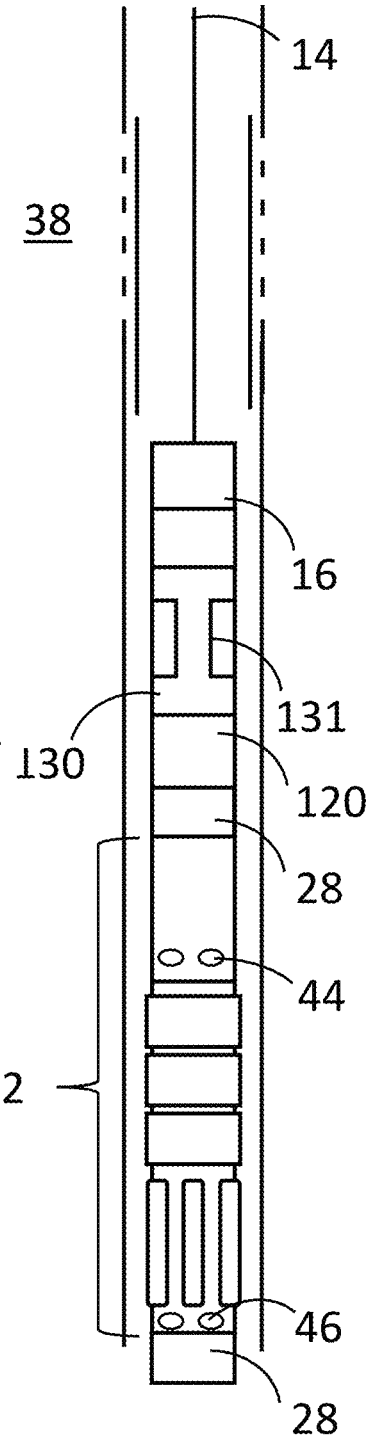

In FIG. 12F, the lower power tool 28 receives a signal from controller 72 to unset the sealing element 20 and anchor elements 23 of the resettable plug downhole tool 12 from the borehole 30. The BHA may then be positioned to a second ported tubular section 115 with the borehole 30 without removing the BHA from the borehole 30.

Figure 13:
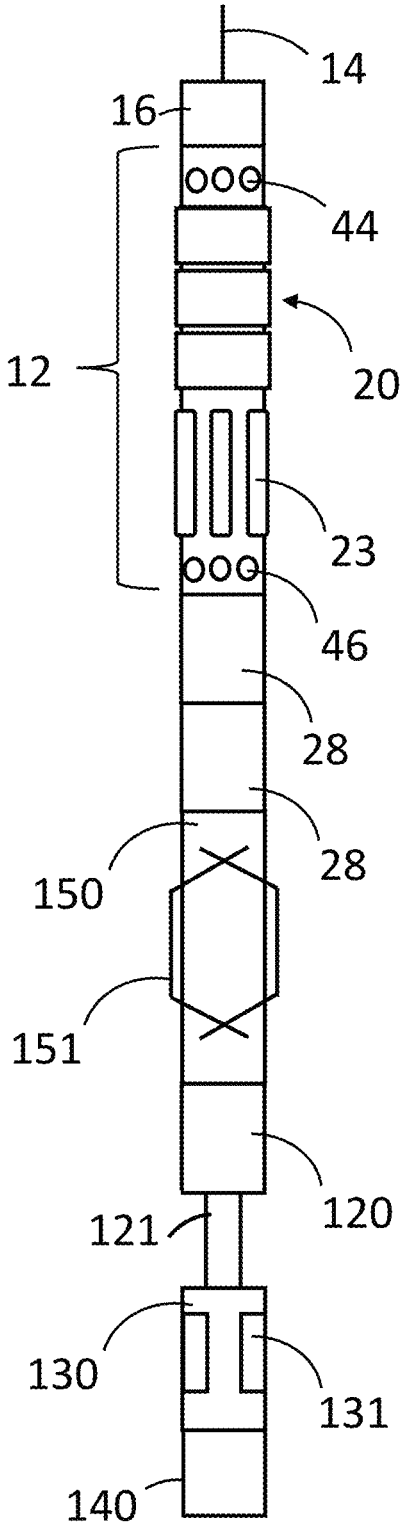
FIG. 13 is a schematic diagram of a bottom hole assembly that may used in a downhole operation, where the resettable plug is positioned above an actuator tool.

FIG. 13 is a schematic diagram of an embodiment of a BHA including, from uphole to downhole, a cable head 16 coupled to a wireline cable 14, a resettable plug downhole tool 12, an upper power tool 28, a lower power tool 28, an anchor tool 150, an actuator tool 120 with an extendable portion 121, a gripping tool 130 with radially extendable gripping elements 131, and a locating tool 140.

Figure 14A:
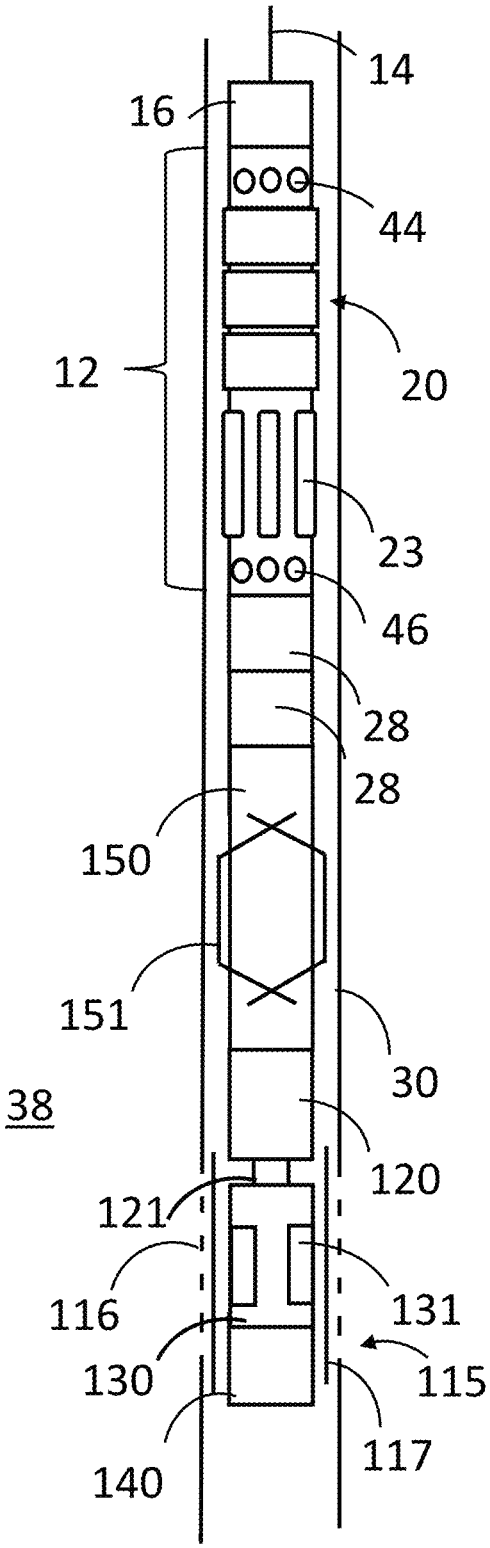
FIG. 14A-F are schematic diagrams of a BHA depicting steps of a downhole operation which includes the opening of a ported tubular segment and isolating portions of the borehole utilizing the BHA of FIG. 13.
Figure 14B:
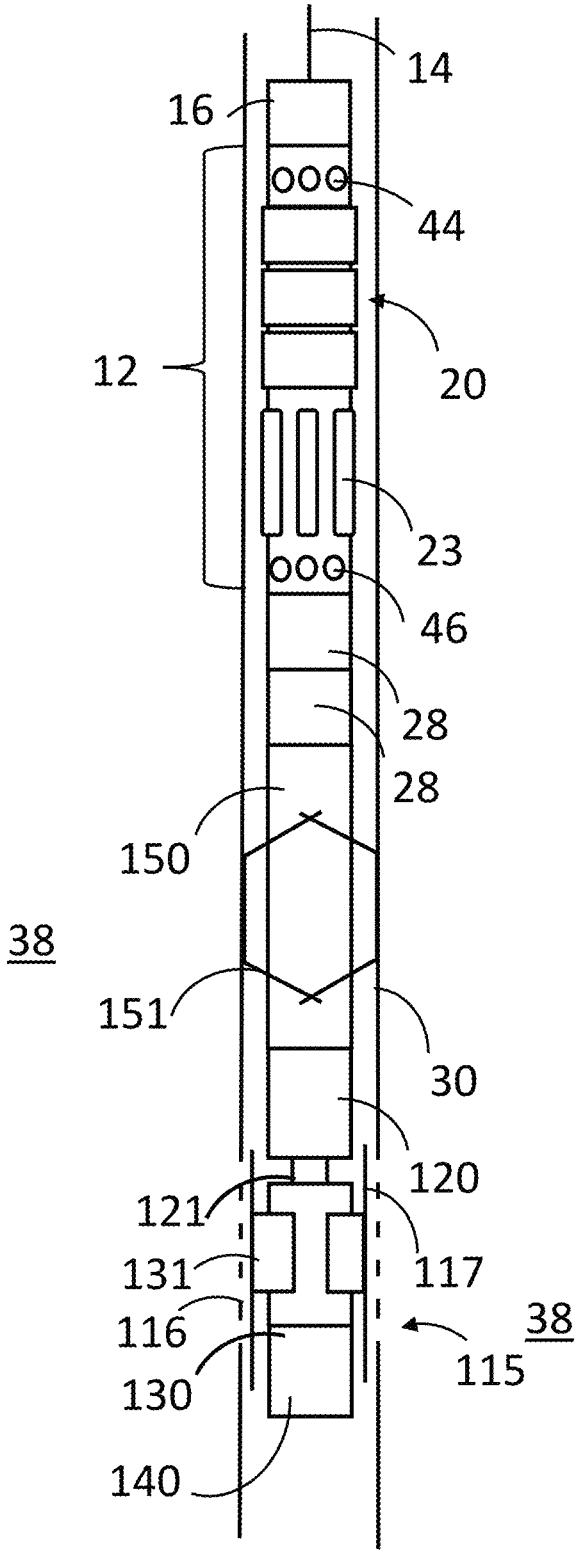

FIG. 14A through FIG. 14F are schematics of the BHA of FIG. 13 at various states of a downhole operation. In FIG. 14A, the locating tool 140 locates the ported tubular section 115 within the borehole 30 and the BHA is positioned above the ported tubular section 115 such that the gripping tool 130 secured to the extendable portion of the actuator 120 is within the closure cover 117. In FIG. 14B, the anchor tool 150 receives hydraulic power from the lower power tool 28 and is activated to engage anchor elements 151 to the borehole 30. Gripping tool 130 also receives power from lower power tool 28 through the actuator tool 120 and extendable portion 121 to engage radially extendable gripping elements 131 to closure cover 117.

Figure 14C:
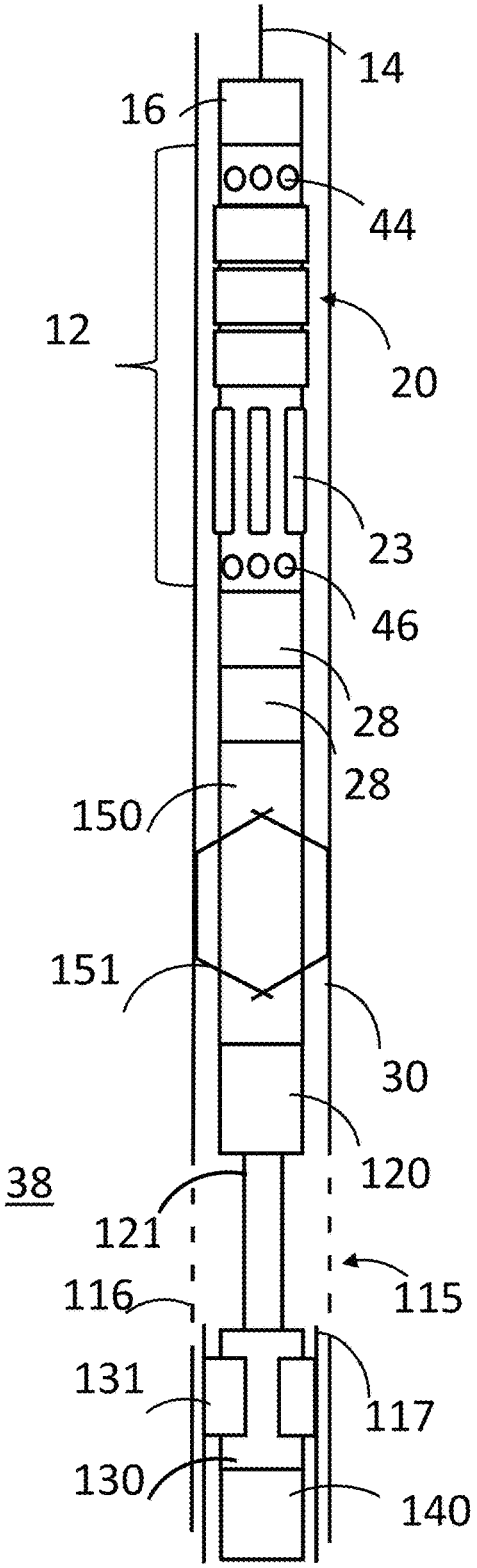
Figure 14D:
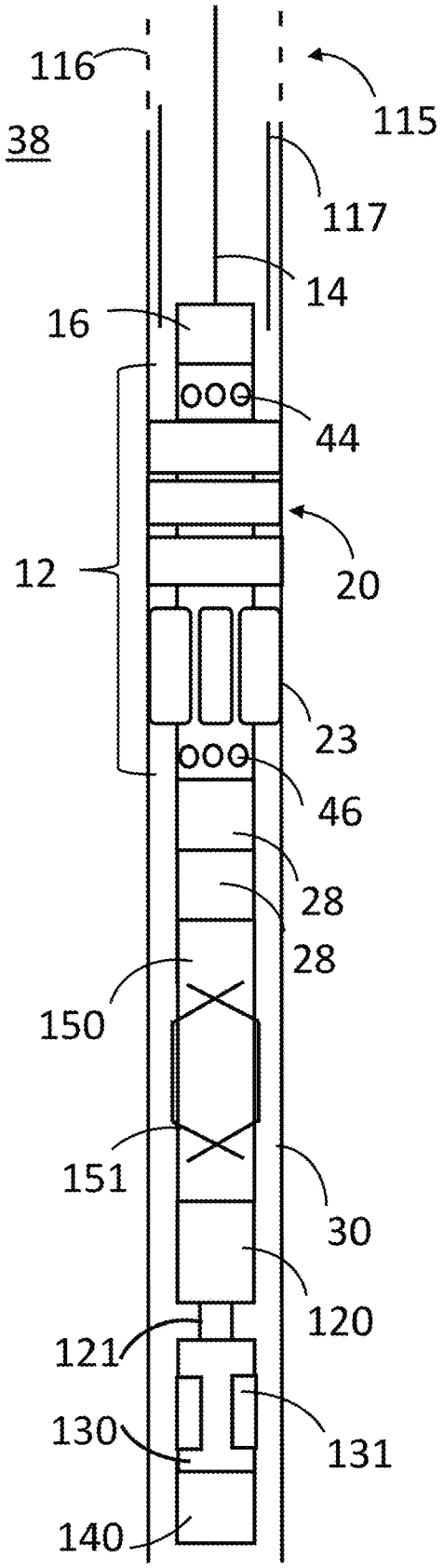
Figure 14E:
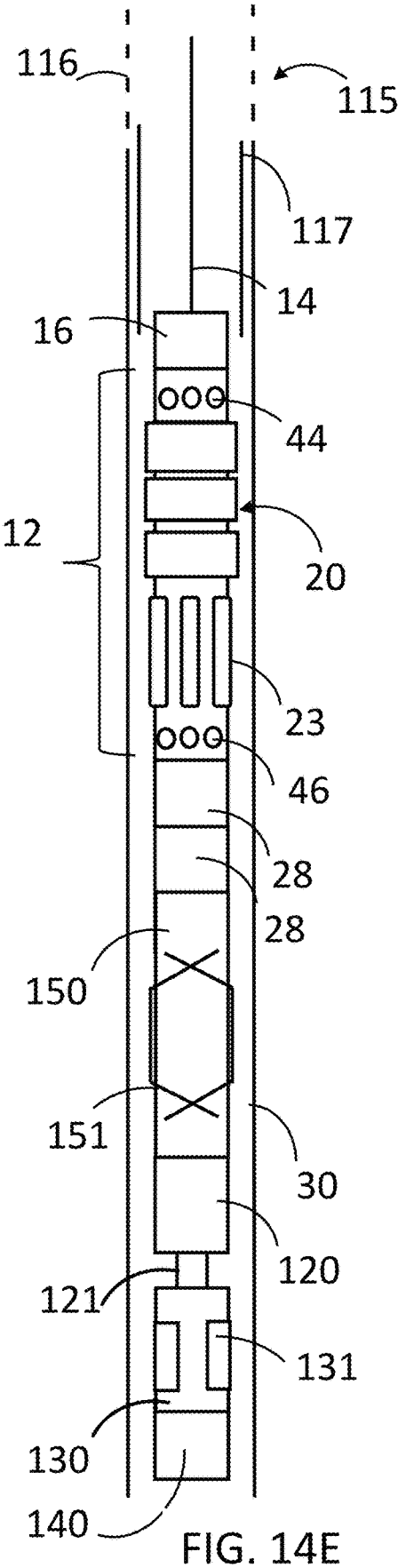
Figure 14F:
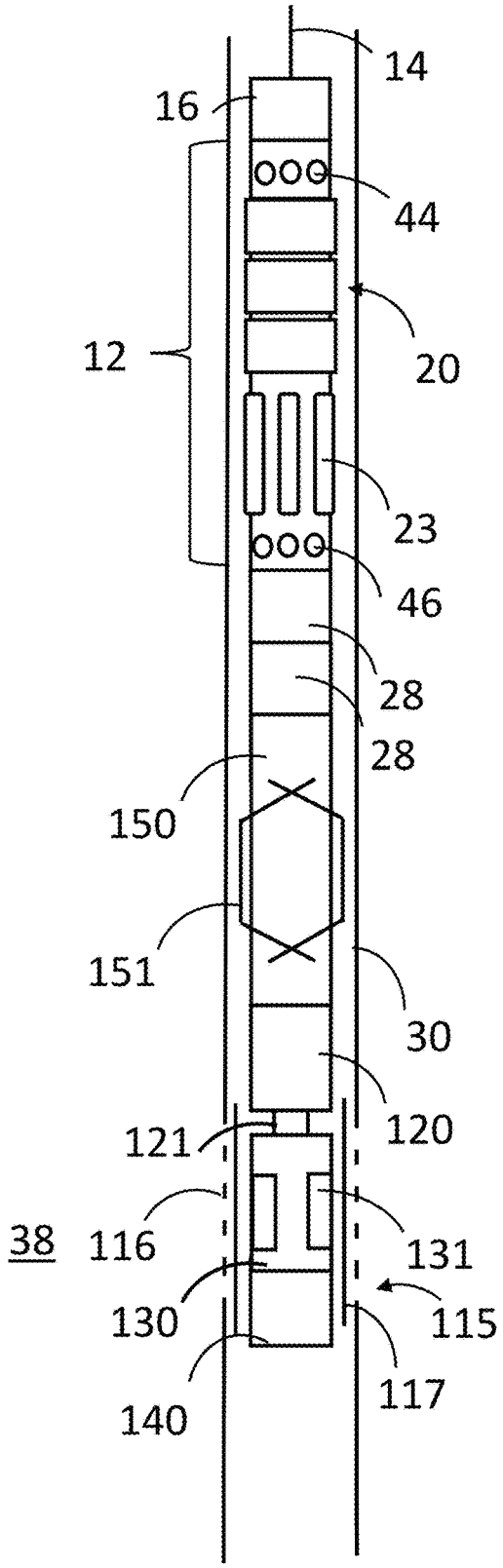

In FIG. 14C, the extendable portion 121 of the actuator 120 is extended with power provided by the lower power tool 28, thereby moving closure cover 117 to the open position as shown in FIG. 10B. The gripping elements 131 and the extendable portion 121 of the actuator 120 may then be retracted, the BHA moved to a position such that the resettable plug downhole tool is near and below the ported tubular section 115, the resettable plug downhole tool 12 receives power from the upper power tool 28 and is activated to set sealing element 20 and anchor elements 23 to the borehole 30 as shown in FIG. 14D. With reference to FIG. 5 of the resettable plug downhole tool, the valve 42 may be moved upward with power from lower power tool 28, such that the openings 43 are misaligned from the openings 46 and the valve 42 is put in a closed condition. A fracture or treatment operation may now commence through ports 116 to formation 38. The valve 42 may be controlled during the fracture or treatment operation. After the fracture or treatment operation, the valve 42 may be moved downward with power from lower power tool 28, such that the openings 43 are aligned with openings 46 and the valve 42 is put in an open position. The upper power tool 28 may subsequently receive a signal from controller 72 to unset the sealing element 20 and anchor elements 23 of the resettable plug downhole tool 12 from the borehole 30 as in FIG. 14E. The BHA may then be positioned to another ported tubular section 115 within the borehole 30 without removing the BHA from the borehole 30 as in FIG. 14F.

The terminology used herein is for the purpose of describing particular embodiments only and is not intended to limit the scope of the claims. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, components and/or groups, but do not preclude the presence or addition of one or more other features, integers, steps, operations, elements, components, and/or groups thereof. The terms "preferably," "preferred," "prefer," "optionally," "may," and similar terms are used to indicate that an item, condition or step being referred to is an optional (not required) feature of the embodiment. The term "seal", as in the engaging of a sealing element to a borehole, is used for the purpose of describing particular embodiments. The term "seal" should not be limited in scope to a perfect seal and may be a partial seal.

The corresponding structures, materials, acts, and equivalents of all means or steps plus function elements in the claims below are intended to include any structure, material, or act for performing the function in combination with other claimed elements as specifically claimed. Embodiments have been presented for purposes of illustration and description, but it is not intended to be exhaustive or limited to the embodiments in the form disclosed. Many modifications and variations will be apparent to those of ordinary skill in the art after reading this disclosure. The disclosed embodiments were chosen and described as non-limiting examples to enable others of ordinary skill in the art to understand these embodiments and other embodiments involving modifications suited to a particular implementation.

What is claimed is:

1. A bottom hole assembly for use within a borehole that extends from surface into a subterranean formation, comprising:

a resettable plug, an actuator tool, a gripping tool, a power tool and a locating tool;

wherein the resettable plug may be activated and deactivated at one or more locations within the borehole without removal from the borehole;

the resettable plug including a central body, a selectively deployable sealing element about a periphery of the central body, and a fluid passageway that extends through the central body from at least one first opening in the central body on a first side of the deployable sealing element to at least one second opening in the central body on a second side of the deployable sealing element;

a valve disposed to control fluid flow through the fluid passageway;

a pressure sensor secured to sense fluid pressure within the borehole on the first side of the deployable sealing element;

a valve actuator coupled to the valve for controlling operation of the valve;

the at least one first opening in fluid communication with the surface via only the borehole on the first side of the deployable sealing element and via the fluid passageway, the at least one second opening on the second side of the deployable sealing element; and the at least one second opening in fluid communication with the borehole on the second side of the deployable sealing element, the borehole below the bottom hole assembly and via the fluid passageway, the at least one first opening on the first side of the deployable sealing element.

2. The bottom hole assembly of claim 1, wherein the actuator tool is secured to and above the power tool, the gripping tool secured to and above the actuator tool, the power tool secured to and above the resettable plug downhole tool, a second power tool secured to and below the resettable plug tool.

3. The bottom hole assembly of claim 1, wherein the power tool is a hydraulic power tool disposed to provide hydraulic power to actuate an extendable portion of the actuator tool and to the gripping tool;

the gripping tool comprising gripping elements disposed to radially engage the gripping tool to a tubular within the borehole.

4. The bottom hole assembly of claim 3, further including a hydraulic pump in fluid communication with a hydraulic reservoir;

an electric motor mechanically coupled to operate the hydraulic pump;

a hydraulic fluid line extending from the hydraulic pump to a solenoid valve block disposed to control the supply of pressurized hydraulic fluid to and from one or more hydraulic lines exiting the power tool.

5. The bottom hole assembly of claim 3, wherein the actuator tool comprises a piston secured to the extendable portion of the actuator tool and isolating a first and second piston chamber; the first piston chamber disposed to receive pressurized hydraulic fluid to linearly actuate the extendable portion of the actuator tool.

6. The bottom hole assembly of claim 3, wherein the actuator tool is a rotary actuator tool that converts rotational force into a linear movement to linearly actuate the extendable portion of the actuator tool.

7. The bottom hole assembly of claim 3, wherein the gripping tool comprises a piston secured to the radially extendable gripping element and isolating a first and second piston chamber; a first piston chamber disposed to receive pressurized hydraulic fluid to actuate the radially extendable gripping component.

8. The bottom hole assembly of claim 3, further comprising an anchor tool wherein the anchor tool comprises a piston, disposed to interact with a radially extendable member and isolating a first and second piston chamber;

the first piston chamber disposed to receive pressurized hydraulic fluid to actuate the radially extendable member.

9. The bottom hole assembly of claim 1, wherein the power tool is an electromechanical power tool disposed to provide mechanical power to an extendable portion of the actuator.

10. The bottom hole assembly of claim 1, wherein the gripping tool comprises radially extendable gripping elements disposed to engage a moveable closure cover selectively blocking or unblocking one or more ports of a ported tubular segment to enable delivery of a hydraulic fracturing or treatment fluid to the subterranean formation through the ported tubular segment.

11. The bottom hole assembly of claim 10, wherein the movable closure cover selectively blocks or unblocks one or more ports of the ported tubular segment by rotation about a predominantly coaxial axis to the borehole axis.

12. A method of delivering a hydraulic fracturing or treatment fluid into a subterranean formation intersected by a borehole, the method comprising the steps of:

deploying the bottom hole assembly of claim 1 into the borehole on a wireline;

utilizing the locating tool to locate a ported tubular segment within the borehole;

positioning the bottom hole assembly near the ported tubular segment such that the resettable plug is below and near the ported tubular segment;

activating the resettable plug downhole tool to engage the borehole, deploy the selectively deployable sealing element isolating an uphole portion of the borehole from a downhole portion of the borehole and secure the bottom hole assembly within the borehole;

extending the actuator tool inside the ported tubular segment;

engaging a closure cover over the ported tubular segment with one or more gripping tool radially extendable gripping elements;

manipulating the actuator tool to open the closure cover over the openings of the ported tubular segment;

pumping a hydraulic fracturing or treatment fluid through the borehole to the ported tubular segment.

13. The method of claim 12, wherein the bottom hole assembly further includes an anchor tool, the method further comprising engaging a radially extendable member of the anchor tool to the borehole.

14. The method of claim 12, further comprising:

controlling operation of the valve while running the bottom hole assembly into the borehole.

15. The method of claim 12, further comprising:

controlling operation of the valve during the delivery of the hydraulic fracturing or treatment fluid to the subterranean formation.

16. The method of claim 12, wherein operation of the valve is further controlled to reduce an amount of fluid or particulate accumulation on top of the resettable plug as a result of the pumping of the hydraulic fracturing or treatment operation of the subterranean formation.

17. The method of claim 16, wherein the fluid or particulate is selected from benzoic acid, naphthalene, rock salt, resins, waxes, polymers, sand, proppant, ceramic materials, debris, or combinations thereof.

18. The method of claim 12, further comprising, monitoring pressure of the hydraulic fracturing or treatment fluid above the deployed selectively deployable sealing element;

upon the pressure reaching a setpoint pressure, controlling operation of the valve to prevent the fluid pressure from exceeding the setpoint pressure, wherein the valve only controls fluid flow through the fluid passageway.

19. The method of claim 18, wherein the pumping step further comprises pressurizing the fluid into the isolated uphole portion of the borehole to hydraulically fracture or treat the subterranean formation above the resettable plug.

20. The method of claim 19, wherein operation of the valve is controlled during the hydraulic fracturing or treatment of the subterranean formation.

21. The method of claim 19, further comprising:

deactivating the resettable plug;

repositioning the bottom hole assembly within the borehole without removing the bottom hole assembly from the borehole;

reactivating the resettable plug within the borehole to isolate a second uphole portion of the borehole from a second downhole portion of the borehole;

pumping a hydraulic fracturing or treatment fluid into the borehole that extends into the subterranean formation;

pressurizing the hydraulic fracturing or treatment fluid into the isolated second uphole portion of the borehole to hydraulically fracture or treat the subterranean formation above the resettable plug.

* * * * *